US006684542B2

(12) United States Patent
Green, III et al.

(10) Patent No.: US 6,684,542 B2
(45) Date of Patent: Feb. 3, 2004

(54) SYSTEM FOR MOUNTING A FLEXIBLE SHEETING MATERIAL TO A SUBSTRATE

(75) Inventors: Frank I. Green, III, Indianapolis, IN (US); Christopher J. Lewis, Dallas, TX (US)

(73) Assignee: Image One, LLC, Indianapolis, IN (US)

( * ) Notice: Subject to any disclaimer, the term of this patent is extended or adjusted under 35 U.S.C. 154(b) by 0 days.

(21) Appl. No.: 10/353,699

(22) Filed: Jan. 29, 2003

(65) Prior Publication Data

US 2003/0140539 A1 Jul. 31, 2003

Related U.S. Application Data

(60) Provisional application No. 60/353,039, filed on Jan. 29, 2002.

(51) Int. Cl.[7] ..... G09F 17/00
(52) U.S. Cl. ..... 40/603; 40/590
(58) Field of Search ..... 40/590, 603; 38/102.91; 160/328

(56) References Cited

U.S. PATENT DOCUMENTS

| | | | | |
|---|---|---|---|---|
| 3,373,464 A | | 3/1968 | Ausnit | |
| 4,862,615 A | * | 9/1989 | Hillstrom | 40/603 |
| 4,955,928 A | | 9/1990 | Tanner | |
| 5,042,182 A | | 8/1991 | King | |
| 5,058,299 A | | 10/1991 | Suzuki | |
| 5,245,774 A | | 9/1993 | Huber | |
| 5,301,447 A | | 4/1994 | Lotter et al. | |
| 5,467,546 A | | 11/1995 | Kovalak, Jr. | |
| 5,664,354 A | | 9/1997 | Daviau et al. | |
| 5,685,099 A | | 11/1997 | Favata | |
| 5,893,227 A | | 4/1999 | Johansson et al. | |
| 6,041,535 A | | 3/2000 | Holloway et al. | |
| 6,073,376 A | | 6/2000 | Verret | |
| 6,250,002 B1 | * | 6/2001 | Wittenberg | 40/603 |
| 6,276,082 B1 | | 8/2001 | Richards et al. | |
| 6,574,895 B2 | * | 6/2003 | Nestor et al. | 40/603 |

* cited by examiner

*Primary Examiner*—Joanne Silbermann
(74) *Attorney, Agent, or Firm*—Woodard, Emhardt, Moriarty, McNett & Henry LLP

(57) ABSTRACT

A system for mounting a flexible sheeting material to a substrate is comprised of a number of frame sections including an elongate support member secured to the substrate and an elongate connector member secured to an end portion of the flexible sheeting material, with the support member and the connector member including interlocking anchor elements capable of forming a releasable interconnection therebetweeen. The support member and the connector member each include a tool engaging portion defining oppositely facing bearing surfaces. A tool is provided which includes a first engaging surface positioned in abutment against one of the bearing surfaces, and a second engaging surface positioned in abutment against the opposite bearing surface. Displacement of the engaging surfaces along the bearing surfaces tensions the flexible sheeting material to a taut state, with the interlocking anchor ribs forming a releasable interconnection to maintain the flexible sheeting material in the taut state.

45 Claims, 17 Drawing Sheets

SYSTEM FOR MOUNTING A FLEXIBLE SHEETING MATERIAL TO A SUBSTRATE

CROSS REFERENCE TO RELATED APPLICATIONS

The present application claims the benefit of Provisional Application Serial No. 60/353,039 filed on Jan. 29, 2002, the contents of which are hereby incorporated by reference in their entirety.

FIELD OF THE INVENTION

The present invention generally relates to a system for mounting a flexible sheeting material to a substrate, and more specifically relates to a frame assembly and associated tooling for tensioning the flexible sheeting material to a taut state and releasably mounting the flexible sheeting material to the substrate to maintain the flexible sheeting material in the taut state.

BACKGROUND OF THE INVENTION

Various types of signs and displays are commonly used as advertisements which must be securely mounted to the sides of vehicles, trailers, buildings, billboards and other types of substrates. Such signs and displays are typically comprised of flexible sheeting material, such as a canvas or plastic material, which exhibits some type of printing, graphics, and/or artwork. In the past, the flexible sheeting material has been secured to a substrate and held in tension by way of a variety of mounting and tensioning systems. A number of such systems are discussed in U.S. Pat. No. 6,041,535 to Holloway et al. Similar to most forms of advertising, the flexible sheeting material must be periodically removed and replaced with flexible sheeting material exhibiting different printing, graphics, and/or artwork. As a result, the mounting and tensioning system should preferably be designed to allow for the quick, efficient and economical removal and replacement of the flexible sheeting material.

Prior mounting and tensioning systems typically require the use of a frame assembly having relatively complex mounting and tensioning mechanisms, thereby tending to increase manufacturing costs. Moreover, such systems typically require that the flexible sheeting material be equipped with a large mounting bead extending about its periphery, and that the frame assembly include a mounting channel sized and shaped to slidably receive the mounting bead therein. In essence, the bead and channel function as a mortise and tenon arrangement to securely connect the flexible sheeting material to the frame assembly. Such a connection arrangement also leads to increase manufacturing costs.

Furthermore, the installation of prior mounting and tensioning systems is labor intensive due in part to the complexity of the mounting and tensioning mechanisms and the required amount of manual manipulation involved with such installations. The associate tooling used to install prior mounting and tensioning systems are also relatively complex and difficult to manipulate, particularly when dealing with relatively large sizes of flexible sheeting material. The added requirement of having to assemble the mortise and tenon connections also tends to increase installation time and associated labor costs.

Thus, there is a general need in the industry to provide an improved system for mounting a flexible sheeting material to a substrate. The present invention satisfies this need and provides other benefits and advantages in a novel and unobvious manner.

SUMMARY OF THE INVENTION

The present invention is directed to a system for mounting a flexible sheeting material to a substrate. While the actual nature of the invention covered herein can only be determined with reference to the claims appended hereto, certain forms of the invention that are characteristic of the preferred embodiments disclosed herein are described briefly as follows. However, it should be understood that other embodiments are also contemplated as falling within the scope of the present invention.

In one form of the present invention, a system is provided for mounting a flexible sheeting material to a substrate, including an elongate support member, an elongate connector member, and a tool. The support member is operatively secured to the substrate and includes an anchoring portion defining a number of first anchor elements and a tool engaging portion defining a first bearing surface. The connector member is formed of a flexibly resilient material and is directly attached to an end portion of the flexible sheeting material. The connector member includes an anchoring portion defining a number of second anchor elements and a tool engaging portion defining a second bearing surface facing generally opposite the first bearing surface. The tool includes a first element defining a first engaging surface positioned in abutment against the first bearing surface, and a second element defining a second engaging surface positioned in abutment against the second bearing surface, wherein displacement of the first and second engaging surfaces along a length of the first and second bearing surfaces tensions the flexible sheeting material to a taut state, with the number of first anchor elements releasably engaging the number of second anchor elements to maintain the flexible sheeting material in the taut state.

In another form of the present invention, a system is provided for mounting a flexible sheeting material to a substrate, including an elongate support member, an elongate connector member, and a tool. The support member is operatively secured to the substrate and includes an anchoring portion defining a number of first anchor elements and a tool engaging portion defining a first bearing surface. The connector member is operatively secured to an end portion of the flexible sheeting material and includes an anchoring portion defining a number of second anchor elements and a tool engaging portion defining a second bearing surface facing generally opposite the first bearing surface. The tool includes a first element comprising a first elongate rail member defining a first engaging surface positioned in abutment against the first bearing surface, and a second element comprising a second elongate rail member defining a second engaging surface positioned in abutment against the second bearing surface, wherein the first and second engaging surfaces are slidably displaced along the first and second bearing surfaces to tension the flexible sheeting material to a taut state, with the number of first anchor elements releasably engaging the number of second anchor elements to maintain the flexible sheeting material in the taut state.

In another form of the present invention, a system is provided for mounting a flexible sheeting material to a substrate, including an elongate support member, an elongate connector member, and a tool. The support member is operatively secured to the substrate and includes an anchoring portion defining a number of first anchor elements and a tool engaging portion defining a first bearing surface. The connector member is operatively secured to an end portion of the flexible sheeting material and includes an anchoring portion defining a number of second anchor elements and a tool engaging portion defining a second bearing surface facing generally opposite the first bearing surface. The tool includes a first element defining a first engaging surface positioned in abutment against the first bearing surface, and a second element defining a second engaging surface positioned in abutment against the second bearing surface, with an area of abutment between the second engaging surface and the second bearing surface being generally aligned with a force plane defined by the flexible sheeting material, wherein displacement of the first and second engaging surfaces along a length of the first and second bearing surfaces tensions the flexible sheeting material to a taut state, with the number of first anchor elements releasably engaging the number of second anchor elements to maintain the flexible sheeting material in the taut state.

In another form of the present invention, a system is provided for mounting a flexible sheeting material to a substrate, including an elongate support member, an elongate connector member, an elongate cover member, and a tool. The support member is operatively secured to the substrate and includes an anchoring portion defining a number of first anchor elements and a tool engaging portion defining a first bearing surface. The connector member is operatively secured to an end portion of the flexible sheeting material and includes an anchoring portion defining a number of second anchor elements and a tool engaging portion defining a second bearing surface facing generally opposite the first bearing surface. The tool includes a first element defining a first engaging surface positioned in abutment against the first bearing surface, and a second element defining a second engaging surface positioned in abutment against the second bearing surface, wherein displacement of the first and second engaging surfaces along a length of the first and second bearing surfaces tensions the flexible sheeting material to a taut state, with the number of first anchor elements releasably engaging the number of second anchor elements at an interconnection location to maintain the flexible sheeting material in the taut state. The cover member is engaged with one of the elongate support member and the elongate connector member to cover the interconnection location.

It is one object of the present invention to provide an improved system for mounting a flexible sheeting material to a substrate.

Further objects, features, advantages, benefits, and aspects of the present invention will become apparent from the drawings and description contained herein.

DESCRIPTION OF THE PREFERRED EMBODIMENTS

Figure 1:
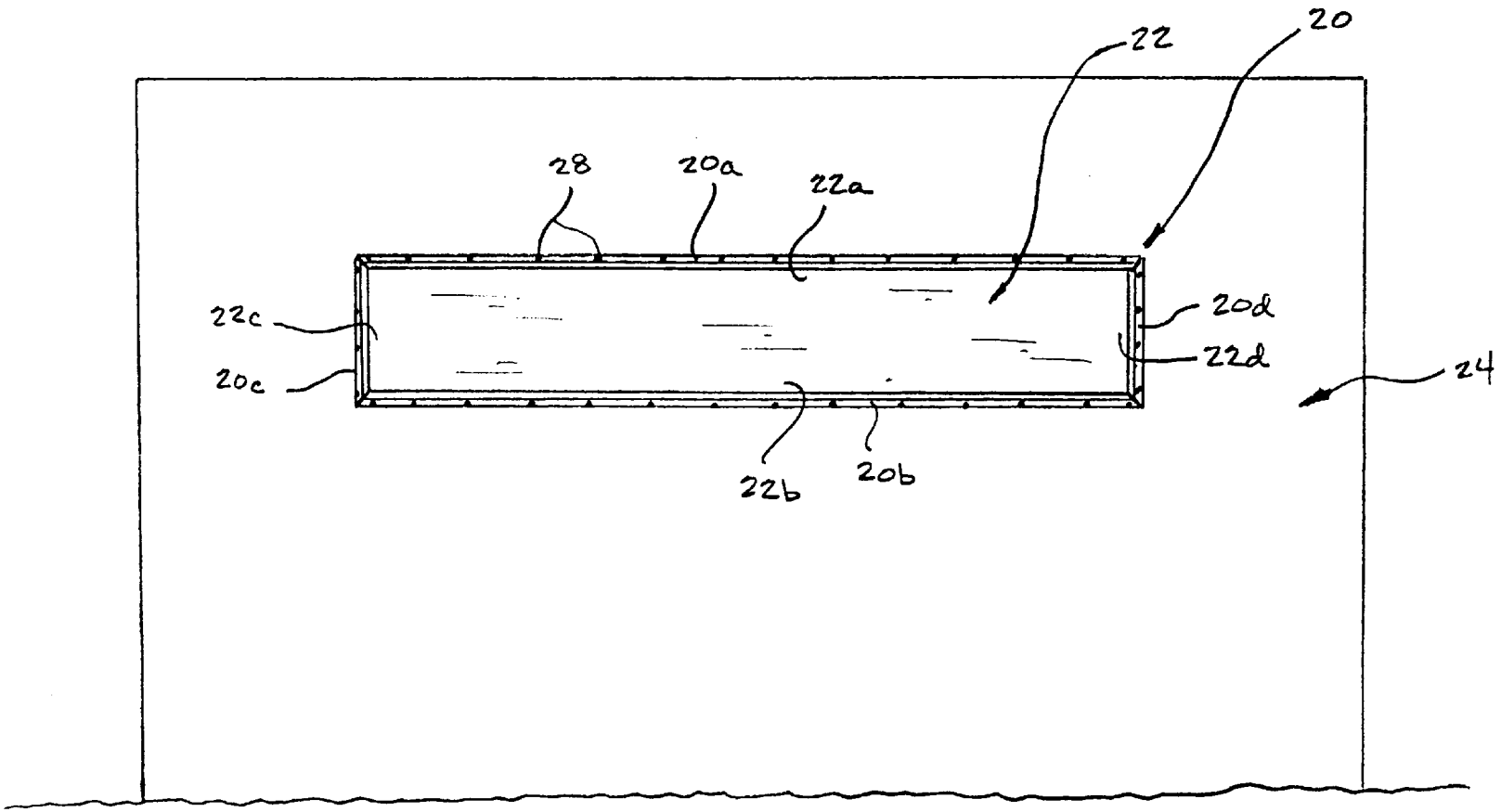
FIG. 1 is an elevational view of a flexible sheeting material mounted to a substrate by a mounting system according to one form of the present invention.

For the purposes of promoting an understanding of the principles of the present invention, reference will now be made to the preferred embodiments illustrated in the drawings and specific language will be used to describe the same. It will nevertheless be understood that no limitation on the scope of the present invention is intended, and that any alterations or modifications in the disclosed embodiments and any further applications of the principles of the present invention are contemplated as would normally occur to one skilled in the art to which the present invention relates.

Figure 1C:
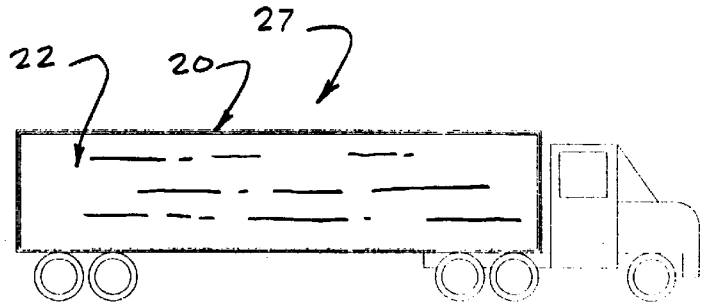
FIG. 1*c* is an elevational view of a truck trailer having a flexible sheeting material mounted thereto by the mounting system illustrated in FIG. 1.
Figure 1B:
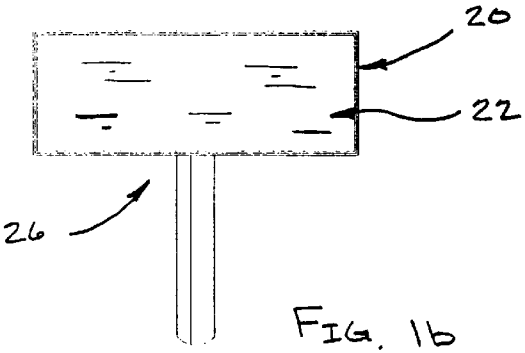
FIG. 1*b* is an elevational view of a billboard having a flexible sheeting material mounted thereto by the mounting system illustrated in FIG. 1.
Figure 1A:
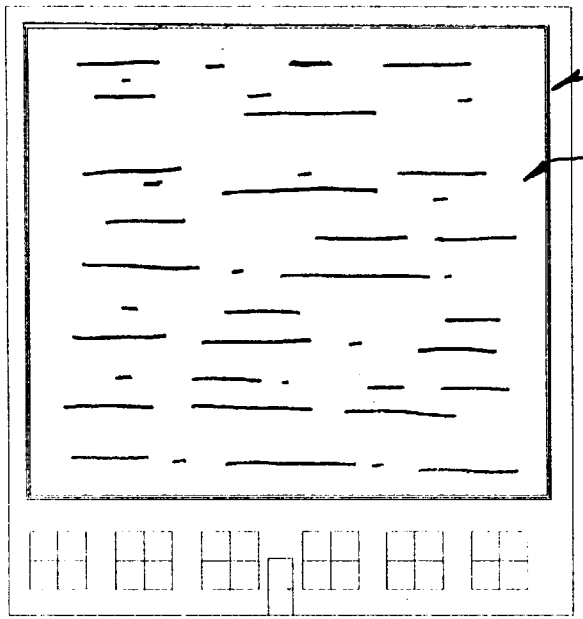
FIG. 1*a* is an elevational view of a building having a flexible sheeting material mounted thereto by the mounting system illustrated in FIG. 1.

Referring to FIG. 1, shown therein is a frame assembly 20 according to one form of the present invention for mounting a flexible sheeting material 22 to a substrate 24. FIGS. 1*a*–1*c* illustrate several types of substrates to which the flexible sheeting material 22 may be mounted, including, by way of example, the side of a building 25, a billboard 26 and a the side of a truck or trailer 27. However, it should be understood that the frame assembly 20 may be used to mount the flexible sheeting material 22 to any other type of substrate that would occur to one of skill in the art.

In one embodiment of the present invention, the frame assembly 20 is comprised of four frame sections 20*a*, 20*b*, 20*c*, 20*d* extending about an outer periphery of the sheeting material 22. Each of the frame sections 20*a–d* preferably has an identical structural configuration, varying only in length and/or orientation. In a preferred embodiment of the invention, the frame sections 20*a–d* are arranged in a rectangular configuration. The upper and lower frame sections 20*a*, 20*b* are preferably arranged in a substantially parallel and symmetrical relationship relative to one another and are operatively attached to a first pair of opposing end portions 22*a*, 22*b* of the sheeting material 22. The right and left frame sections 20*c*, 20*d* are preferably arranged in a substantially parallel and symmetrical relationship relative to one another and are operatively attached to a second pair of opposing end portions 22*c*, 22*d* of the sheeting material 22. The frame sections 20*a–d* are in turn operatively secured to the substrate 24 by any method that would occur to one of skill in the art, such as, for example, by fastening. In one embodiment, the frame sections 20*a–d* are secured to the substrate 24 by a number of fasteners 28, such as, for example, screws, nuts and bolts, rivets or any other type of fastening device that would occur to one of skill in the art.

Although the frame assembly 20 has been illustrated and described as extending about the entire outer periphery of the sheeting material 22, it should be understood that the frame assembly 20 may alternatively extend about only a portion of the outer periphery of the sheeting material 22. It should also be understood that any number of frame sections may be used to mount the sheeting material 22 to the substrate 24, including a single frame section attached to one end portion of the sheeting material 22, with an opposite end portion of the sheeting material 22 being mounted to the substrate 24 by any other method that would occur to one of skill in the art. Additionally, although the sheeting material 22 has been illustrated and described as having a rectangular configuration, it should be understood that other configurations are also contemplated, including triangular configurations, other polygonal configurations, and/or curvilinear configurations.

In one embodiment of the invention, the flexible sheeting material 22 is formed of a plastic or polymeric material. In a specific embodiment, the sheeting material 22 is formed of a vinyl material, such as, for example, a polyvinyl chloride (PVC). It should be understood, however, that the sheeting material 22 could be formed of other plastic materials, such as, for example, a polyester or a polyethylene. It should also be understood that other types of materials are also contemplated, including fabric materials, fiber materials, composite materials, or any other suitable flexible sheeting material that would occur to one of skill in the art. The outwardly facing surface of the sheeting material 22 preferably exhibits some type of printing, graphics, and/or art work, or any other type of imaging, the application of which would be apparent to one of skill in the art. The outwardly facing surface of the sheeting material 22 may also be coated or laminated with a layer of PVC material.

Figure 2:
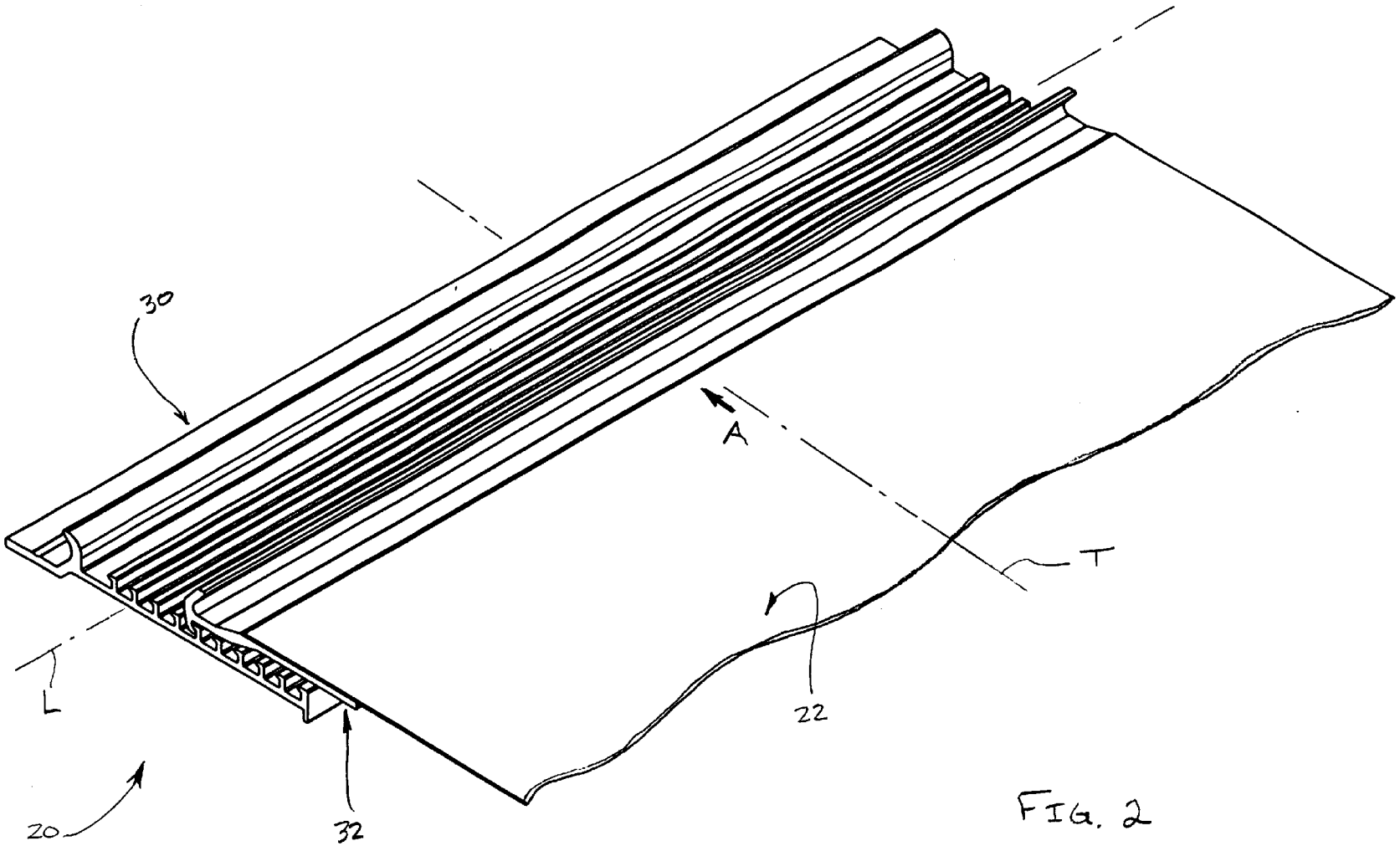
FIG. 2 is a perspective view of a frame assembly according to one form of the present invention.

Referring to FIG. 2, the frame assembly 20 is generally comprised of an elongate support member 30 and an elongate connector member 32, each having a length extending along a longitudinal axis L. As will be discussed in further detail below, the connector member 32 is operatively secured to the flexible sheeting material 22 and is displaceable along a transverse axis T (in the direction of arrow A) to tension the flexible sheeting material 22 to a taut state. As will also be discussed in further detail below, the support member 30 and the connector member 32 include structural features that interlock with one another to releasably interconnect the connector member 32 with the support member 30 to maintain the flexible sheeting material 22 in the taut state.

Figure 3:
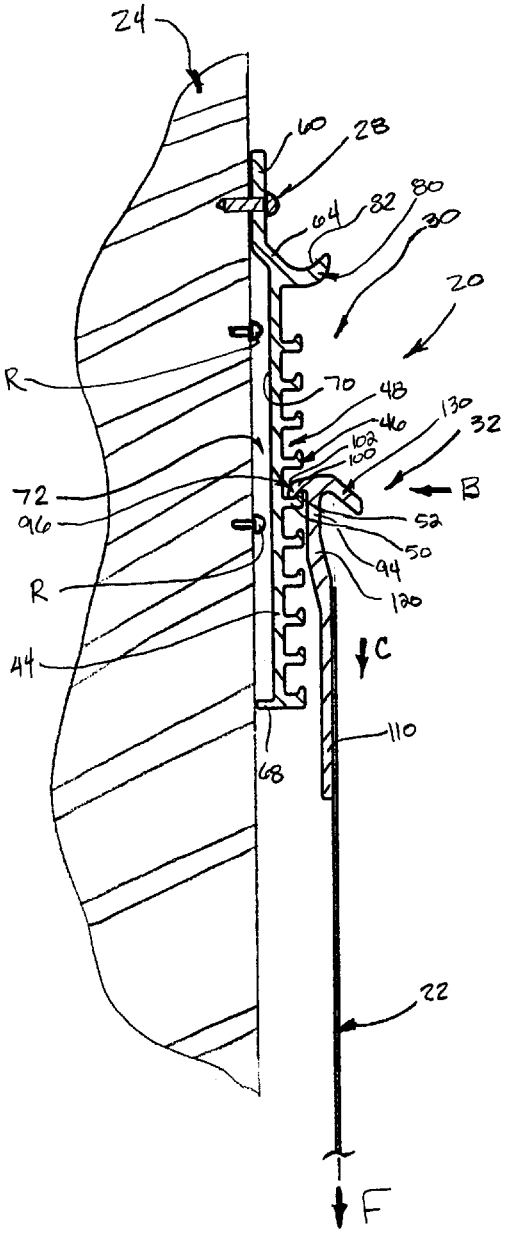
FIG. 3 is an end view of the frame assembly illustrated in FIG. 2, as secured to a substrate.
Figure 4:
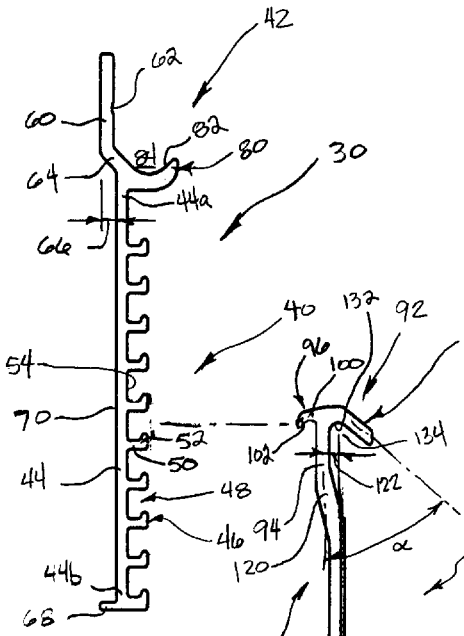
FIG. 4 is an end view of a support frame member according to one embodiment of the present invention.
Figure 5:
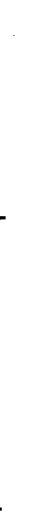
FIG. 5 is an end view of a connector frame member according to one embodiment of the present invention.

Referring to FIGS. 3–5, shown therein are additional structural details regarding the support member 30 and the connector member 32. The support member 30 generally includes an anchoring portion 40 and a tool engaging portion 42. The anchoring portion 40 is configured for attachment to the substrate 24 and also provides a means for releasably interlocking with the connector member 32. The tool engaging portion 42 is configured for engagement with an installation tool to provide a means for tensioning the flexible sheeting material 22 to a taut state. The support member 30 is preferably formed of a substantially rigid material. In a specific embodiment of the invention, the support member 30 is formed of aluminum; however, other materials are also contemplated, including other metallic materials such as steel, or non-metallic materials such as a plastic material or a polymeric material. Due to its relatively complex geometric configuration and substantially uniform longitudinal cross-section, the support member 30 is preferably formed as an extrusion. However, other suitable manufacturing methods are also contemplated, including casting, molding or machining.

The anchoring portion 40 of the support member 30 preferably includes an anchor plate 44 defining a number of anchor elements 46 extending substantially the entire length of the plate 44. In a preferred embodiment of the invention, the anchor plate 44 is relatively flat and the anchor elements 46 are comprised of a plurality of rows of ribs extending laterally from the plate 44. In one embodiment, the rows of anchor ribs 46 are spaced apart from one another so as to define a retention groove 48 between adjacent rows of anchor ribs 46. The anchor ribs 46 are preferably oriented in a substantially parallel arrangement and are preferably uniformly offset from one another. However, it should be understood that other configurations and orientations of the anchor plate 44 and/or the anchor ribs 46 are also contemplated as falling within the scope of the present invention. It should also be understood that the support member 30 may include any number of anchor ribs 46, including a single anchor rib 46 or two or more rows of anchor ribs 46.

Each of the anchor ribs 46 preferably has a substantially uniform shape and configuration. In one embodiment of the invention, the anchor ribs 46 have an L-shaped hook configuration, including a web portion 50 extending laterally from an outwardly facing surface 54 of plate 44, and a hook portion 52 extending from the web portion 50. In a specific embodiment of the invention, the web 50 extends substantially perpendicularly from the surface 54 of plate 44, and the hook 52 extends substantially perpendicularly from the web 50. Although a specific shape and configuration of the anchor ribs 46 have been illustrated and described herein, it should be understood that other shapes and configurations of the anchor ribs 46 are also contemplated as falling within the scope of the present invention. For example, the web 50 may extend from the anchor plate 44 at an oblique angle. Similarly, the hook 52 may extend from the web 50 at an oblique angle.

The anchoring portion 40 of the support member 30 also preferably includes an attachment plate 60 extending from a first end portion 44*a* of the anchor plate 44. In one embodiment of the invention, the attachment plate 60 is relatively flat to facilitate secure engagement against a corresponding flat surface of the substrate 24. A notch 62 may be defined along the length of the attachment plate 60 through which extend a number of fasteners 28 to secure the support member 30 to the substrate 24. In a preferred embodiment of the invention, the attachment plate 60 is connected to the anchor plate 44 by an intermediate spacer portion 64 to provide an offset distance 66 therebetween, the importance of which will become apparent below. A spacer rail 68 preferably extends laterally from an inwardly facing surface 70 of a second end portion 44*b* of the anchor plate 44. The spacer rail 68 preferably extends a distance substantially equal to the distance of the offset distance 66. As shown in FIG. 3, when the support member 30 is secured to the substrate 24, an open area or recess 72 is established between the inner surface 70 of the anchor plate 44 and the substrate 24, with the attachment plate 60 and the spacer rail 68 abutting the substrate 24 to provide stabilization to the support member 30. In certain applications of the invention, the substrate 24 may include a number of rows of projections or protuberances, such as, for example, the heads of rivets R or other types of fasteners. The recessed area 72 defined between the anchor plate 44 and the substrate 24 may be positioned over such projections or protuberances to maintain secure abutment against the substrate 24 via the attachment plate 60 and the spacer rail 68.

As discussed above, the tool engaging portion 42 is configured for engagement with an installation tool to provide a means for tensioning the flexible sheeting material 22 to a taut state. The tool engaging portion 42 includes an engagement element 80 that preferably extends along substantially the entire length of the support member 30. In a preferred embodiment of the invention, the engagement element 80 is configured as a support rail extending laterally from the anchor plate 44 and oriented substantially parallel with the anchor ribs 46. The support rail 80 preferably includes a concave bearing surface 82 generally facing away from the anchor ribs 46 and preferably extending along substantially the entire length of support member 30. The concave bearing surface 82 in turn defines a groove 84. In one embodiment of the invention, the groove 84 has a circular shape, and in a more specific embodiment has a hemi-cylindrical configuration. However, it should be understood that other shapes and configurations are also contemplated, such as, for example, other types of arcuate configurations, a polygonal configuration, or a flat configuration. It should also be understood that the inner periphery of the hemi-cylindrical bottom portion of the groove 84 may extend about less than 180 degrees or greater than 180 degrees. Further details regarding the function of the tool engaging portion 42 will be discussed below.

The connector member 32 generally includes an anchoring portion 90 and a tool engaging portion 92. The anchoring portion 90 is configured for attachment to the flexible sheeting material 22 and also provides a means for releasably interlocking with the support member 32. The tool engaging portion 92 is configured for engagement with an installation tool to provide a means for tensioning the flexible sheeting material 22 to a taut state. The connector member 32 is preferably formed of a flexibly resilient material. In one embodiment of the invention, the connector member 32 is formed of a plastic material or a polymeric material. In a specific embodiment, the connector member 32 is formed of a vinyl material, such as, for example, a polyvinyl chloride (PVC). It should be understood, however, that the connector member 32 may be formed of other types of plastic or polymeric materials, such as, for example, polyethylene, or any other suitable flexibly resilient material that would occur to one of skill in the art. In other embodiments of the invention, the connector member 32 may be formed of metallic materials, such as, for example, aluminum or steel. Due to its relatively complex geometric configuration and substantially uniform longitudinal cross-section, the connector member 32 is preferably formed as an extrusion. However, other suitable manufacturing methods are also contemplated, including casting, molding or machining.

The anchoring portion 90 of the connector member 32 preferably includes an anchor plate 94 defining at least one anchor element 96 extending substantially the entire length of the plate 94. In a preferred embodiment of the invention, the anchor plate 94 is relatively flat and the anchor element 96 is comprised of a rib extending laterally from the plate 94. In one embodiment of the invention, the anchor rib 96 is configured similar to that of the anchor ribs 46 associated with the support member 30. Specifically, the anchor rib 96 preferably has an L-shaped hook configuration, including a web portion 100 extending laterally from the anchor plate 94, and a hook portion 102 extending from the web portion 100. In one embodiment of the invention, the web 100 extends substantially perpendicularly from the plate 94 and the hook 102 extends substantially perpendicularly from the web 100. Although a specific embodiment of the anchor rib 96 has been illustrated and described herein, it should be understood that other shapes and configurations of the anchor rib 96 are also contemplated as falling within the scope of the present invention, including those alternative embodiments described above with regard to the anchor ribs 46. It should also be understood that the connector member 32 may define any number of anchor ribs 96, including two or more rows of anchor ribs 96.

The anchoring portion 90 of the connector member 32 also preferably includes an attachment plate 110 extending from the anchor plate 94. In one embodiment of the invention, the attachment plate 110 is relatively flat to facilitate secure engagement with the flexible sheeting material 22. In a preferred embodiment of the invention, the flexible sheeting material 22 is secured to a surface 112 of the attachment plate 110 by bonding, such as, for example, by radio-frequency (RF) welding or by any other bonding technique that would occur to one of skill in the art. Other methods of securing the flexible sheeting material 22 to the attachment plate 110 are also contemplated, such as, for example, by adhesion, impulse or heat sealing, fastening, sewing or any other suitable method of attachment that would occur to one of skill in the art. It is also contemplated that the attachment plate 110 could be integrally formed with the flexible sheeting material 22 to form a unitary single-piece structure. Additionally, although the sheeting material 22 is illustrated and described as being attached to the surface 112 of attachment plate 110, it should be understood that the sheeting material 22 could alternatively be attached to other portions of the plate 110, including the surface 114 opposite the surface 112. In a preferred embodiment of the invention, the attachment plate 110 is connected to the anchor plate 94 by an intermediate spacer portion 120 to provide an offset distance 122 therebetween, the importance of which will become apparent below.

As discussed above, the tool engaging portion 92 is configured for engagement with an installation tool to provide a means for tensioning the flexible sheeting material 22 to a taut state. The tool engaging portion 92 includes an engagement element 130 that preferably extends along substantially the entire length of the connector member 32. In a preferred embodiment of the invention, the engagement element 130 is configured as a connector rail extending laterally from the anchor plate 94 and positioned generally opposite the anchor rib 96. The connector rail 130 preferably extends from the anchor plate 94 at an angle α. In one embodiment of the invention, the angle α falls within a range of about 30 degrees and about 60 degrees. In a specific embodiment, the angle α is about 45 degrees. It should be understood, however, that in other embodiments of the invention, the angle α may be less than 30 degrees or greater than 60 degrees.

In a preferred embodiment of the invention, the location adjacent the intersection between the connector rail 130 and the anchor plate 94 defines a concave bearing surface 132 generally facing the flexible sheeting material 22. The concave bearing surface 132 in turn defines a groove 134 preferably extending along substantially the entire length of connector member 32. In one embodiment of the invention, the concave bearing surface 132 has a circular shape. However, it should be understood that the bearing surface 132 can take on other shapes and configurations as well, such as, for example, other arcuate configurations, a polygonal configuration, or a flat configuration. It should also be understood that the inner periphery of the concave surface 132 may extend about less than 180 degrees or greater than 180 degrees. Further details regarding the function of the tool engaging portion 92 will be discussed below.

As shown in FIG. 3, the hook-shaped anchor rib 96 of the connector member 32 is sized and shaped to be laterally received within a corresponding retention groove 48 in the support member 30 in the direction of arrow B. Once positioned within the retention groove 48, a slight axial displacement of the connector member 32 in the direction of arrow C will cause the hook-shaped anchor rib 96 to interlock with an adjacent hook-shaped anchor rib 46 of support member 30. Notably, since the hook portions 52, 102 of the respective anchor ribs 46, 96 extend in substantially opposite directions, the hook portions 52, 102 cooperate with one another to prevent lateral disengagement of the connector member 32 from the support member 30.

As should be apparent, when a tension force F is applied to the flexible sheeting material 22, the lateral interlocking engagement between the hook portions 52, 102 will prevent the anchor rib 96 from being laterally displaced and removed from the corresponding retention groove 48 in the support member 30. However, upon removal of the tension force F from the flexible sheeting material 22, the connector member 32 may be slight displaced in a direction opposite arrow C, and the hook-shaped anchor rib 96 may be laterally displaced in a direction opposite arrow B to release the connector member 32 from the support member 30. As should also be apparent, the hook-shaped anchor rib 96 may be positioned in any one of the corresponding retention grooves 48 to produce the requisite amount of tension force F within the flexible sheeting material 22. Notably, the rigid nature of the support member 30 provides adequate support to resist the axial tension force F exerted by the flexible sheeting material 22, as well as any lateral forces that might be exerted by the flexible sheeting material 22. However, the flexibly resilient nature of the connector member 32 provides a certain degree of freedom or play between the connector member 32 and the support member 30 to compensate for any misalignment therebetween and/or to aid in the insertion/removal of the anchor rib 96 into/from the corresponding retention groove 48.

Figure 6A:
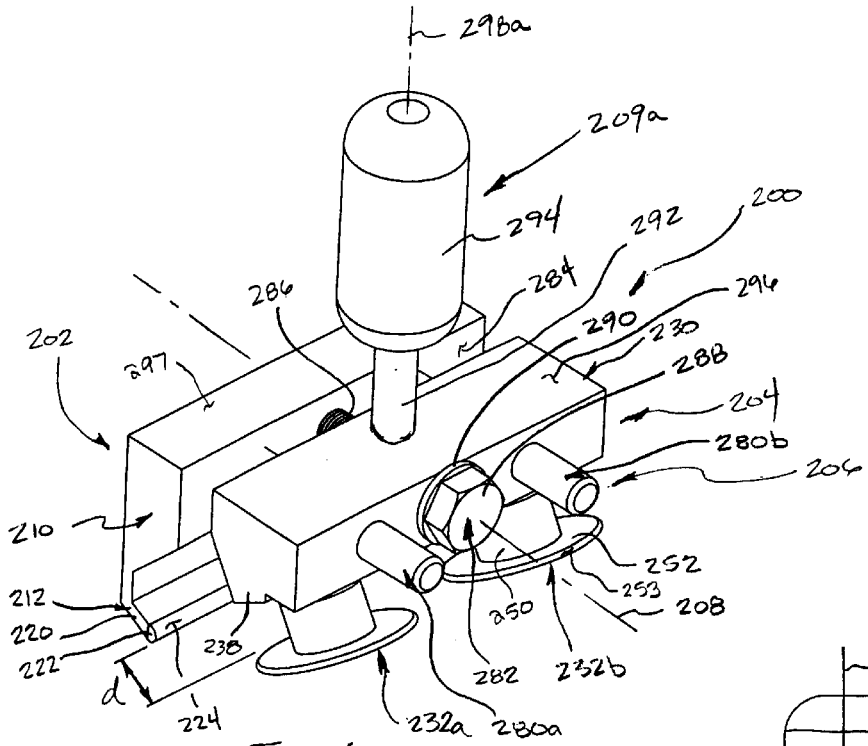
FIG. 6 is a perspective view of an installation tool according to one form of the present invention for use in association with the frame assembly illustrated in FIG. 2.
Figure 7:
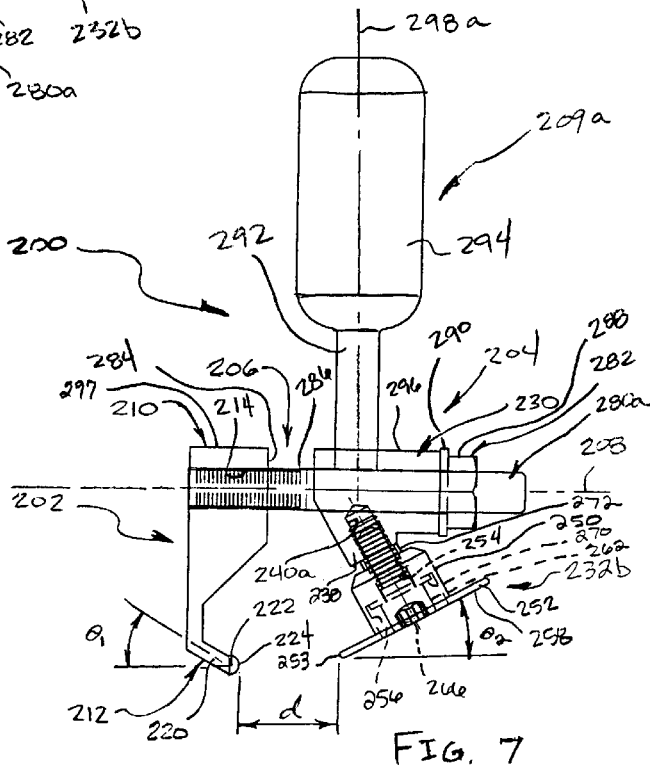
FIG. 7 is an end view of the installation tool illustrated in FIG. 6.
Figure 8:
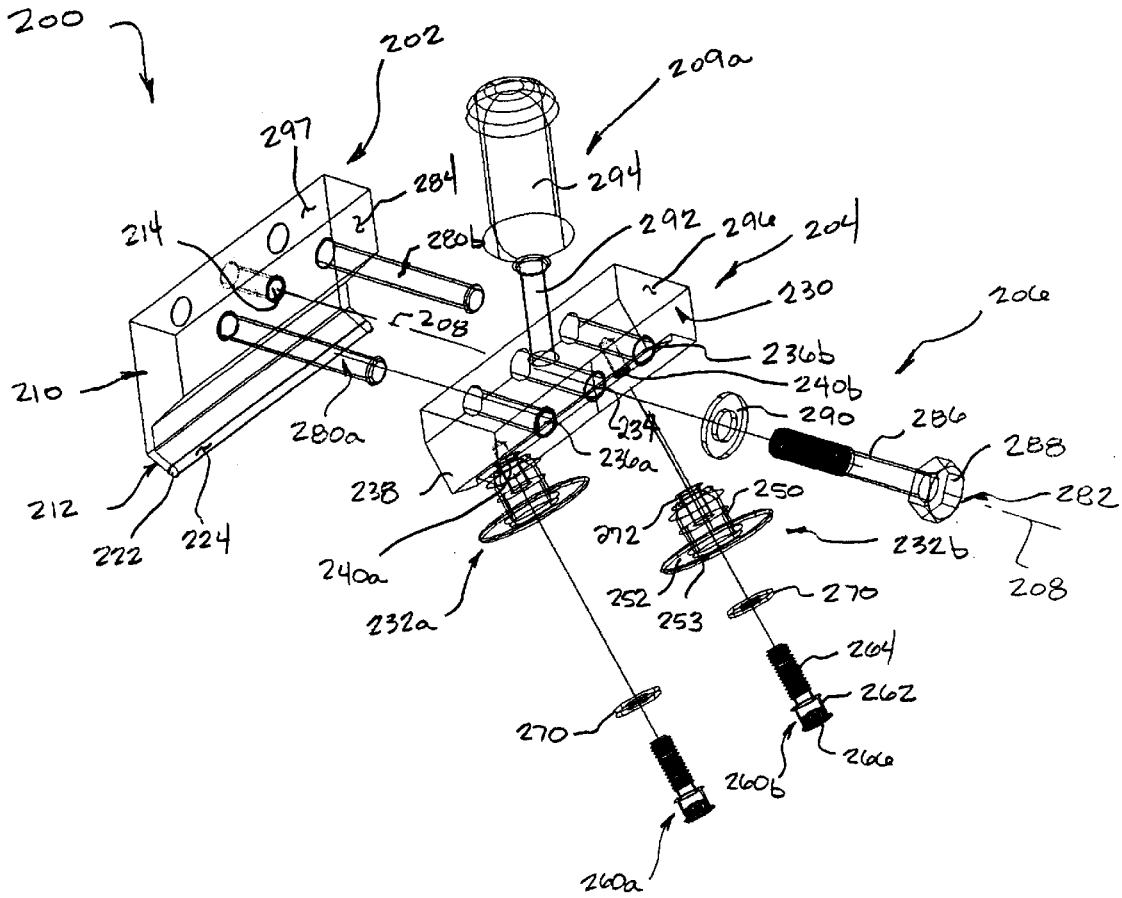
FIG. 8 is an exploded perspective view of the installation tool illustrated in FIG. 6.

Referring now to FIGS. 6–8, shown therein is an installation tool 200 according to one form of the present invention. As will become apparent, the installation tool 200 is configured to engage the support member 30 and the connector member 32 to produce a select amount of tension force F within the flexible sheeting material 22. The installation tool 200 is generally comprised of a stationary element 202, a movable element 204, an adjustment mechanism 206 adapted to displace the movable element 204 relative to the stationary element 202 along a displacement axis 208, and a pair of handles 209*a*, 209*b* to aid in the manipulation and handling of the installation tool 200.

In a preferred embodiment of the invention, the stationary element 202 includes a block portion 210 and an engaging portion 212 extending therefrom. The block portion 210 preferably includes a threaded passage 214 formed at least partially therethrough and extending generally along the displacement axis 208. The engaging portion 212 is preferably comprised of a rail 220 projecting from the block portion 210 and preferably extending along substantially the entire length of the block portion 210. The tool rail 220 is preferably inwardly tapered at an angle $\theta_1$ relative to an axis aligned substantially parallel with the displacement axis 208. In one embodiment of the invention, the angle $\theta_1$ falls within a range of about 15 degrees and about 45 degrees. In a more specific embodiment, the angle $\theta_1$ is about 26 degrees. However, it should be understood that other angles $\theta_1$ are also contemplated, including angles less than 15 degrees or greater than 45 degrees.

The tool rail 220 preferably includes a rounded distal end portion 222 defining a convex engaging surface 224 preferably extending along substantially the entire length of the rail 220. In one embodiment of the invention, the convex engaging surface 224 has a circular shape, and in a more specific embodiment has a hemi-cylindrical configuration. However, it should be understood that the engaging surface 224 can take on other shapes and configurations as well, such as, for example, other arcuate configurations, a polygonal configuration, or a flat configuration. It should also be understood that the outer periphery of the convex engaging surface 224 may extend about less than 180 degrees or greater than 180 degrees. In a preferred embodiment of the invention, the engaging surface 224 has a shape and configuration substantially complementary to that of the bearing surface 82 of the support rail 80.

The block portion 210 is preferably formed of a substantially rigid, lightweight material, such as, for example, aluminum. However, other material are also contemplated, including other metallic materials such as steel, or non-metallic materials such as a plastic or polymeric material. In a preferred embodiment of the invention, at least the distal end portion 222 of the tool rail 220 is formed of material having a relatively low coefficient of friction to promote sliding engagement between the engaging surface 224 and a corresponding bearing surface. In one embodiment, the distal end portion 222 is formed of a plastic or polymeric material, such as, for example, Nylon or Teflon. It should be understood, however, that other materials are also contemplated, including metallic materials such as steel or aluminum.

In a preferred embodiment of the invention, the movable element 204 includes a block portion 230 and a pair of engaging rollers 232*a*, 232*b* attached thereto. The block portion 230 preferably includes a central passage 234 extending generally along the displacement axis 208, and a pair of apertures 236*a*, 236*b* positioned on either side of the passage 234 and arranged generally parallel with the displacement axis 208. The block 230 also preferably includes a mounting portion 238 defining a pair of threaded openings 240*a* and 240*b* for mounting the rollers 232*a*, 232*b* to the block portion. In one embodiment of the invention, the rollers 232*a*, 232*b* are each comprised of a cylindrical-shaped base portion 250 and an annular flange portion 252 extending about the circumference of the base portion 250. The distal edge of the annular flange 252 preferably includes a rounded engaging surface 253. However, other shapes and configurations of the distal edge are also contemplated. In a preferred embodiment of the invention, the engaging surface 253 has a shape and configuration substantially complementary to that of the bearing surface 132 of the connector rail 130.

An axial passage 254 preferably extends through each of the rollers 232*a*, 232*b*, with the passage 254 defining a counter bore 256 extending from an end surface 258 of the roller adjacent the annular flange 252. Each of the rollers 232*a*, 232*b* are rotatably mounted to the mounting portion 238 by a respective fastener 260*a*, 260*b*. Each of the fasteners 260*a*, 260*b* includes a head portion 262 and a threaded shank portion 264. The threaded shank 264 extends through the axial 254 and is threadingly engaged within a respective one of the threaded openings 240*a*, 240*b* in the mounting portion 238, with the head 262 being disposed within the counter bore 256 and recessed below the end surface 258. The head 262 includes a recess 266 configured to accept a driving tool to aid in threading the fasteners 260*a*, 260*b* into the threaded openings 240*a*, 242*b*. In one embodiment, the recess 266 has a hexagonal configuration; however, other configurations are also contemplated. A washer 270, such as a lock washer, is preferably disposed between the head 262 of each fastener and the bottom surface of the counter bore 256 to prevent the fasteners 260*a*, 260*b* from loosening and backing out. A bushing 272 is preferably disposed about the threaded shank 264 of each fastener and positioned between the cylindrical base portion 250 of each roller and the mounting portion 238 of the block. In the illustrated embodiment of the invention, the bushing 272 is integrally formed with the cylindrical base portion 250 of each roller. However, it should be understood that the bushing 272 may alternatively be integrally formed with the mounting portion 238, or may be formed separately as an individual component. The bushing 272 acts as a bearing between the base portion 250 of the roller and the mounting portion 238 to facilitate free rotation of the rollers 232*a*, 232*b* and to minimize wear. The bushing 272 may be formed of a plastic or polymeric material, such as, for example, Nylon or Teflon, or may be formed of a metallic material, such as, for example, bronze or copper.

The annular flange 252 of the rollers 232*a*, 232*b* is preferably inwardly tapered at an angle $\theta_2$ relative to an axis aligned substantially parallel with the displacement axis 208. In one embodiment of the invention, the angle $\theta_2$ falls within a range of about 15 degrees to about 45 degrees. In a more specific embodiment, the angle $\theta_2$ is about 26 degrees. However, it should be understood that other angles $\theta_2$ are also contemplated, including angles less than 15 degrees or greater than 45 degrees. As shown in FIG. 7, the engaging surface 224 of the tool rail 220 is arranged generally opposite the engaging surface 253 of the rollers 232*a*, 232*b*, with the engaging surfaces 224, 253 being separated by a distance d. As will be discussed below, in a preferred embodiment of the invention, the distance d separating the engaging surfaces 224, 253 is adjustable by way of the adjusting mechanism 206.

The block portion 230 is preferably formed of a substantially rigid, lightweight material, such as, for example, aluminum. However, other material are also contemplated, including other metallic materials such as steel, or non-metallic materials such as a plastic or polymeric material. The engaging rollers 232*a*, 232*b* are preferably formed of a rigid, wear-resistant material, such as, for example, steel or aluminum. It should be understood, however, that other materials are also contemplated, including non-metallic materials such as a plastic or polymeric material. Additionally, although the installation tool 200 has been illustrated and described as including a pair of engaging rollers 232*a*, 232*b*, it should be understood that any number of rollers may be used, including a single roller or three or more rollers.

The adjustment mechanism 206 is generally comprised of a pair of guide rods 280*a*, 280*b* and an adjustment screw 282. The guide rods 280*a*, 280*b* preferably extend from an inwardly facing surface 284 of the stationary block 210 and are preferably arranged generally parallel to one another and generally parallel with the displacement axis 208. The guide rods 280*a*, 280*b* are preferably sized and shaped to be slidably received within the apertures 236*a*, 236*b* in the block 230, and serve to guide the movable element 204 relative to the stationary element 202 generally along the displacement axis 208. The adjustment screw 282 includes a partially threaded shank 286 and a head 288. The shank 286 extends through the central passage 234 in block 230 and is threadingly engaged within the threaded passage 214 in the block 210. A washer 290 is preferably disposed between the head 288 and the block 230.

As should be apparent, rotation of the adjustment screw 282 will correspondingly adjust the distance d between the engaging surfaces 224, 253 of the tool 200. When the adjustment screw 282 is threadingly advanced into the threaded passage 214 of block 210, the screw head 288 will exert a compression force onto the block 230. As a result, the movable element 204 will be guidably displaced toward the stationary element 202 generally along the displacement axis 208 to correspondingly reduce the distance d between the engaging surfaces 224, 253. Similarly, when the adjustment screw 282 is unthreaded from the threaded passage 214, the movable element 204 may be displaced away from the stationary element 202 to correspondingly increase the distance d between the engaging surfaces 224, 253.

The handles 209*a*, 209*b* of tool 200 preferably include a connector shaft portion 292 and an enlarged gripping portion 294. In one embodiment of the invention, the gripping portion 294 has a cylindrical configuration and is sized and shaped to be easily and comfortably grasped by the operator of the tool 200. In a preferred embodiment of the invention, one of the handles 209*a* extends from an upper surface 296 of the movable block 230, while the other handle 209*b* extends from an upper surface 297 of the stationary block 210. Providing each of the blocks 230, 210 with a respective handle 209*a*, 209*b* aids the operator in handling and manipulating the installation tool 200. It should be understood, however, that both of the handles 209*a*, 209*b* may extend from the same block 210, 230 and/or from other portions of the blocks 210, 230. In a preferred embodiment of the invention, the handle 209*a* extends along a first axis 298*a* and the handle 209*b* extends along a second axis 298*b*, with the first axis 298*a* being angularly offset relative to the second axis 298*b*. Orienting the handles 209*a*, 209*b* at different angles relative to one another further aids the operator in handling and manipulating the installation tool 200 by providing a means for exerting forces onto the installation tool 200 in more than one plane and/or in more than one direction. Although the installation tool 200 has been illustrated and described as including a pair of handles, it should be understood that any number of handles may be used to aid in manipulation and handling of the installation tool 200, including a single handle, or three or more handles. Moreover, although a specific configuration and orientation of the handles 209*a*, 209*b* have been illustrated and described, it should be understood that other configurations and orientations are also contemplated.

Having described various structural and functional features of the frame assembly 20 and the installation tool 200, reference will now be made to a method of mounting and tensioning the flexible sheeting material 22 according to one form of the present invention. Referring once again to FIG. 1, as discussed above, the upper and lower frame sections 20*a*, 20*b* are preferably arranged in a substantially parallel and symmetrical relationship relative to one another. Similarly, the right and left frame sections 20*c*, 20*d* are preferably arranged in a substantially parallel and symmetrical relationship relative to one another. The upper portion 22*a* of the flexible sheeting material 22 is initially secured to the upper frame section 20*a* by manually positioning the anchor rib 96 of the connector member 32 within one of the retention grooves 48 in the support member 30, with the anchor rib 96 interlocking with an adjacent anchor rib 46. Similarly, one of the side portions 22*c*, 22*d* of the flexible sheeting material 22 is initially secured to a corresponding left/right frame section 20*c*, 22*d*. The installation tool 200 may then be used to tension the flexible sheeting material 22 in both the vertical direction and the horizontal direction, and to secure the unanchored end portions of the flexible sheeting material 22 to the appropriate frame section 20*a–d*.

Figure 9:
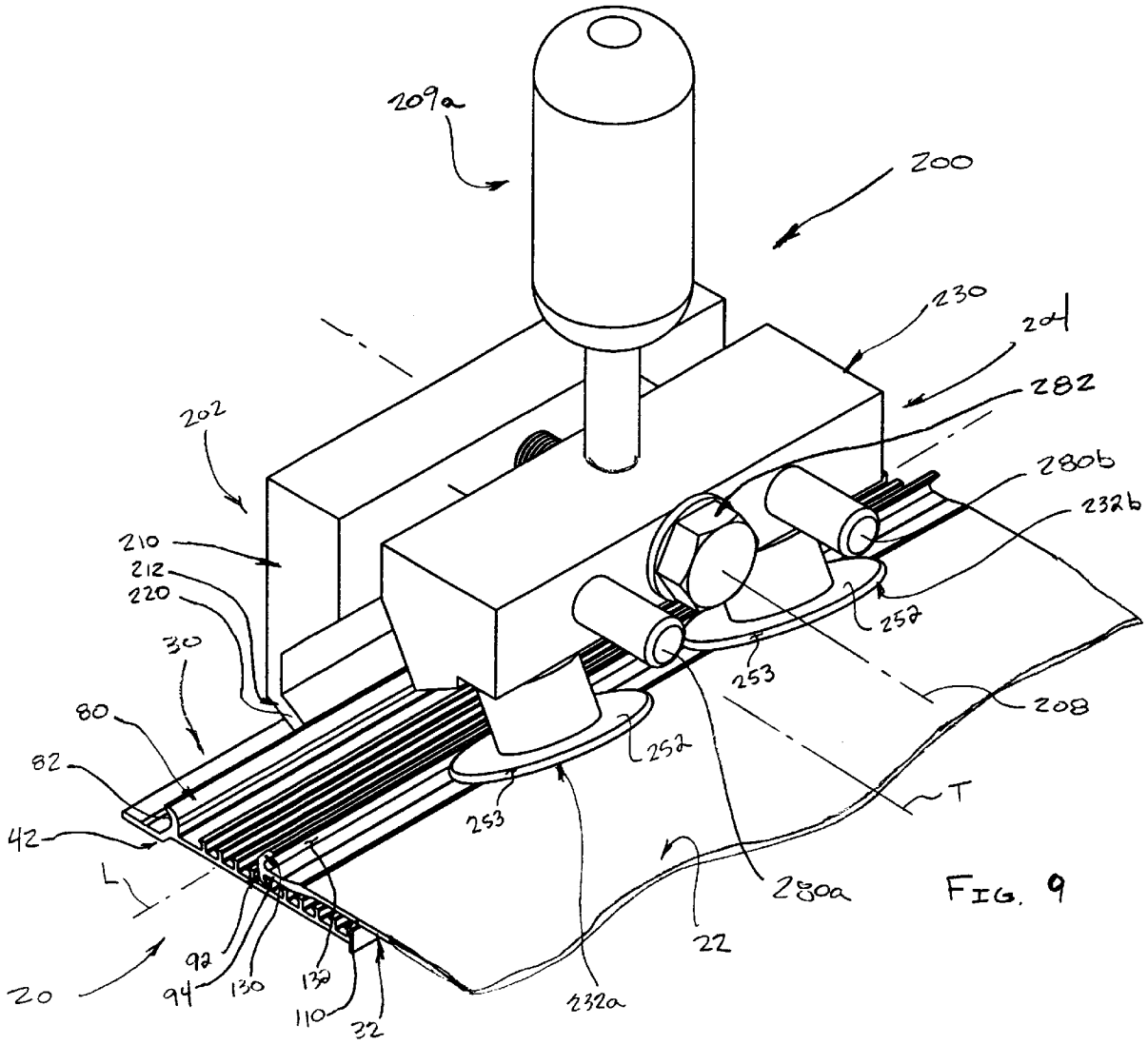
FIG. 9 is a perspective view of the installation tool illustrated in FIG. 6, as engaged with the frame assembly illustrated in FIGS. 2 and 3.
Figure 10:
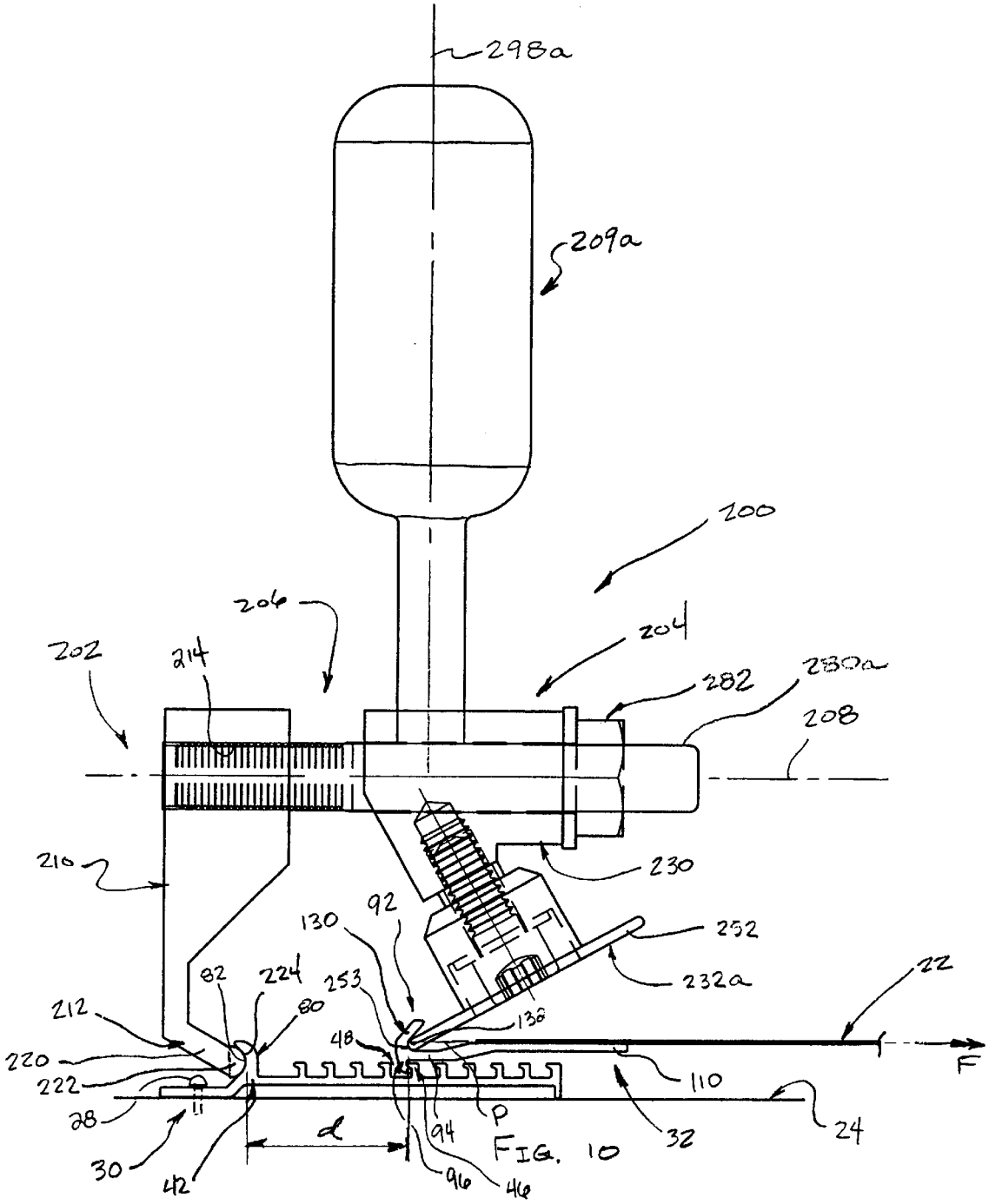
FIG. 10 is an end view of the installation tool illustrated in FIG. 6, as engaged with the frame assembly illustrated in FIGS. 2 and 3.

Referring to FIGS. 9 and 10, shown therein is the installation tool 200 engaged with one of the frame sections 20*a–d* of the frame assembly 20. Preferably, the installation tool 200 is initially engaged with an end portion of the selected frame section 20*a–d*. As will become apparent, displacement of the installation tool 200 along the length of the selected frame section toward the opposite end portion will correspondingly tension the flexible sheeting material 22 to a taut state. The connector member 32 may then be anchored to the corresponding support member 30 to maintain the flexible sheeting material 22 in the taut state.

The rail 220 of the tool 200 is initially engaged with the support rail 80 of the support member 30. Specifically, the convex engaging surface 224 defined by the distal end portion 222 of the rail 220 is positioned in abutment against the concave bearing surface 82 of the support rail 80. As discussed above, the tool rail 220 preferably extends substantially the entire length of the stationary block 210, thereby tending to stabilize engagement between the tool rail 220 and the support rail 80 to correspondingly reduce the likelihood of disengagement of the tool 200 from the frame assembly 20. However, the shape and configuration of the abutting bearing/engaging surfaces 82, 224 allows for substantially uninhibited axial displacement of the tool rail 220 along the support rail 80. Moreover, the shape and configuration of the abutting bearing/engaging surfaces 82, 224 also allows for substantially uninhibited pivotal movement of the tool rail 220 relative to the support rail 80 about the longitudinal travel axis. As discussed above, the distal end portion 222 of the tool rail 220 is preferably formed of a material having a relatively low coefficient of friction, thereby tending to facilitate sliding engagement between the abutting bearing/engaging surfaces 82, 224, particularly during axial displacement of the tool rail 220 along the support rail 80.

The engaging rollers 232*a*, 232*b* of the tool 200 are operatively engaged with the connector rail 130 of the connector member 32. Specifically, the convex engaging surface 253 defined by the outer edge of the annular flange 252 of each roller 232*a*, 232*b* is positioned in abutment against the concave bearing surface 132 of the connector rail 130. As discussed above, the connector rail 130 preferably extends from the anchor plate 94 at an angle $\alpha$ (FIG. 5), and the annular flange 252 of the rollers 232*a*, 232*b* is preferably inwardly tapered at an angle $\theta_2$ (FIG. 7). In a preferred embodiment of the invention, the angle $\alpha$ of the connector rail 130 is somewhat larger than taper angle $\theta_2$ of the annular flange 252 of the rollers 232*a*, 232*b* to allow substantially uninhibited rotation of the rollers 232*a*, 232*b*. Such an angular relationship between the connector rail 130 and the annular flange 252 tends to reduce the likelihood that the rollers 232*a*, 232*b* will seize or bind up within the groove 134 of the connection rail 130. Moreover, the angular relationship between the connector rail 130 and the annular flange 252 also substantially prevents lateral or pivotal movement of the rollers 232*a*, 232*b* relative to the connector member 32 to stabilize engagement therebetween and to correspondingly reduce the likelihood of disengagement of the tool 200 from the frame assembly 20.

Although the rollers 232*a*, 232*b* have been illustrated and described as being associated with the movable block 230, and the tool rail 220 has been illustrated and described as being associated with the stationary block 210, it should be understood that the rollers 232*a*, 232*b* may alternatively be associated with the stationary block 210 with the tool rail 220 being associated with the movable block 230. Likewise, although the rollers 232*a*, 232*b* have been illustrated and described as being engagable with the connector member 32, and the tool rail 220 has been illustrated and described as being engagable with the support member 30, it should be understood that the rollers 232*a*, 232*b* may alternatively be engagable with the support member 30 with the tool rail 220 being engagable with the connector member 32.

As shown in FIG. 10, when the installation tool 200 is properly engaged with the frame assembly 20, the force plane P defined by the flexible sheeting material 22 will be substantially aligned with the area of abutment between the roller engaging surfaces 253 and the connector rail bearing surface 132. As should be apparent, such alignment is possible due to the inclusion of the offset 122 between the anchor plate 92 and the attachment plate 110 (FIG. 5). In this manner, the compression force exerted by the rollers 232*a*, 232*b* onto the connector rail 130 will be substantially aligned with and will directly oppose the tension force F exerted by the flexible sheeting material 22 along the force plane P. As a result, engagement of the installation tool 200 with the connector member 32 will not exert an appreciable torsional or rotational force onto the connector member 32 during tensioning of the flexible sheeting material 22. The tendency for the connector member 32 to rotate during tensioning of the flexible sheeting material 22 will therefore be substantially reduced if not eliminated entirely, thereby reducing the likelihood of the connector member 32 from becoming misaligned and/or misoriented relative to the support member 30 during tensioning of the sheeting material 22.

Once the installation tool 200 is properly engaged with the frame assembly 20, the adjustment screw 282 may be rotated to threadingly advance the screw 282 into the threaded passage 214 of the stationary block 210. Such threading advancement will correspondingly displace the movable block 230 toward the stationary block 210, with the guide rods 280*a*, 280*b* directing the movable block 230 generally along the displacement axis 208. As should be apparent, displacement of the movable block 230 toward the stationary block 210 will correspondingly reduce the distance d between the engaging surface 224 of the tool rail 220 and the engaging surface 253 of the rollers 232*a*, 232*b*, which will correspondingly increase the tension force F within the flexible sheeting material 22.

When the flexible sheeting material 22 is tensioned to the appropriate level of tautness, the anchor rib 96 of the connector member 32 will be correspondingly positioned adjacent the lateral opening of a corresponding retention groove 48 defined along the support member 20. The tool 200 may then displaced along the length of the frame assembly 20, with the engaging surface 224 of the tool rail 220 being slidably displaced along the bearing surface 82 of the support rail 80, and with the engaging surface 253 of the rollers 232*a*, 232*b* being rotatably displaced along the bearing surface 132 of the connector rail 130. Axial displacement of the tool 200 along the length of the frame assembly 20 will correspondingly position the anchor rib 96 adjacent the lateral opening of the corresponding retention groove 48 along substantially the entire length of the support member 20.

As the tool 200 is axially displaced along the length of the frame assembly 20, the simultaneous application of a slight inward force onto the movable block 230 (toward the frame assembly 20) will cause the tool 200 to pivot about the abutting surfaces 82, 224 of the support rail 80 and the tool rail 220. Such pivotal displacement will in turn cause the anchor rib 96 to be laterally displaced and correspondingly received within the adjacent retention groove 48 as the installation tool 200 is progressively displaced along the frame assembly 20. Once the anchor rib 96 is positioned within the appropriate retention groove 48, further axial displacement of the installation tool 200 along the frame assembly 20 will result in the release of a slight amount of tension force F from the flexible sheeting material 22. As a result, the anchor rib 96 of the connector member 32 will become interlocked with the adjacent anchor rib 46 of the support member 30. The interlocking engagement between the anchor ribs 46, 96 will limit lateral displacement of the connector member 32 relative to the support member 30 to prevent disengagement therebetween so long as the flexible sheeting material 22 remains in a taut state.

As should be appreciated, the flexible sheeting material 22 is preferably slightly over-tensioned to accommodate for the slight release of tension force F necessary to cause the anchor ribs 46, 96 to interlock with one another. As discussed above, the rigid nature of the support member 30 provides the support necessary to retain the flexible sheeting material 22 in its taut state and to resist any lateral forces that might be exerted by the flexible sheeting material 22 onto the frame assembly 20. As also discussed above, the flexibly resilient nature of the connector member 32 provides a certain degree of freedom or play to compensate for any misalignment between the connector member 32 and the support member 30 during the installation procedure. The flexibly resilient nature of the connector member 32 also acts as a means for reducing the potential build-up of stress at the location of attachment between the attachment plate 110 and the sheeting material 22 which might otherwise result in detachment of the sheeting material 22 from the connector member 32.

Once the anchor rib 96 of the connector member 32 is disposed within the appropriate retention groove 48 of the support member 30 and interlockingly engaged with the corresponding anchor rib 46, the installation tool 200 may be removed from the frame assembly 20. Removal of the tool 200 may be accomplished by unthreading the adjustment screw 282 from the threaded opening 214 and displacing the movable block 230 away from the stationary block 210 to correspondingly increase the distance d between the tool rail 220 the rollers 232*a*, 232*b*. The installation tool 200 may then be laterally removed from the frame assembly 20 and engaged with any other frame section 20*a–d* that remains in an unanchored condition until the flexible sheeting material 22 is tensioned in both the vertical and horizontal directions.

As should be apparent, the flexible sheeting material 22 may be removed from the frame assembly 20 by essentially reversing the above-discussed method for tensioning and mounting. Specifically, the installation tool 200 is initially engaged with an end portion of a selected frame section 20*a–d*, with the tool rail 220 engaging the support rail 80 and with the rollers 232*a*, 232*b* engaging the connector rail 130 (FIG. 10). The adjustment screw 282 may then be rotated to threadingly advance the screw 282 into the threaded passage 214 of the stationary block 210 to correspondingly displace the movable block 230 toward the stationary block 210. The movable block 230 is displaced toward the stationary block 210 until the anchor rib 96 of the connector member 32 is correspondingly positioned adjacent the lateral opening of the retention groove 48, with the distal end of the hook portion 102 positioned beyond the distal end of the hook portion 52. The tool 200 may then be axially displaced along the length of the frame assembly 20 to correspondingly position the anchor rib 96 adjacent the lateral opening of the retention groove 48 along substantially the entire length of the support member 20. As should be apparent, the simultaneous application of a slight outward force onto the movable block 230 (away from frame assembly 20) will cause the tool 200 to pivot about the abutting surfaces 82, 224 of the support rail 80 and the tool rail 220. Such pivotal displacement will in turn cause the anchor rib 96 to be laterally displaced and correspondingly removed from the retention groove 48 as the installation tool 200 is progressively displaced along the frame assembly 20. Once the anchor rib 96 is removed from the retention groove 48, further axial displacement of the installation tool 200 along the frame assembly 20 will result in the release of the tension force F in the flexible sheeting material 22.

Figure 11:
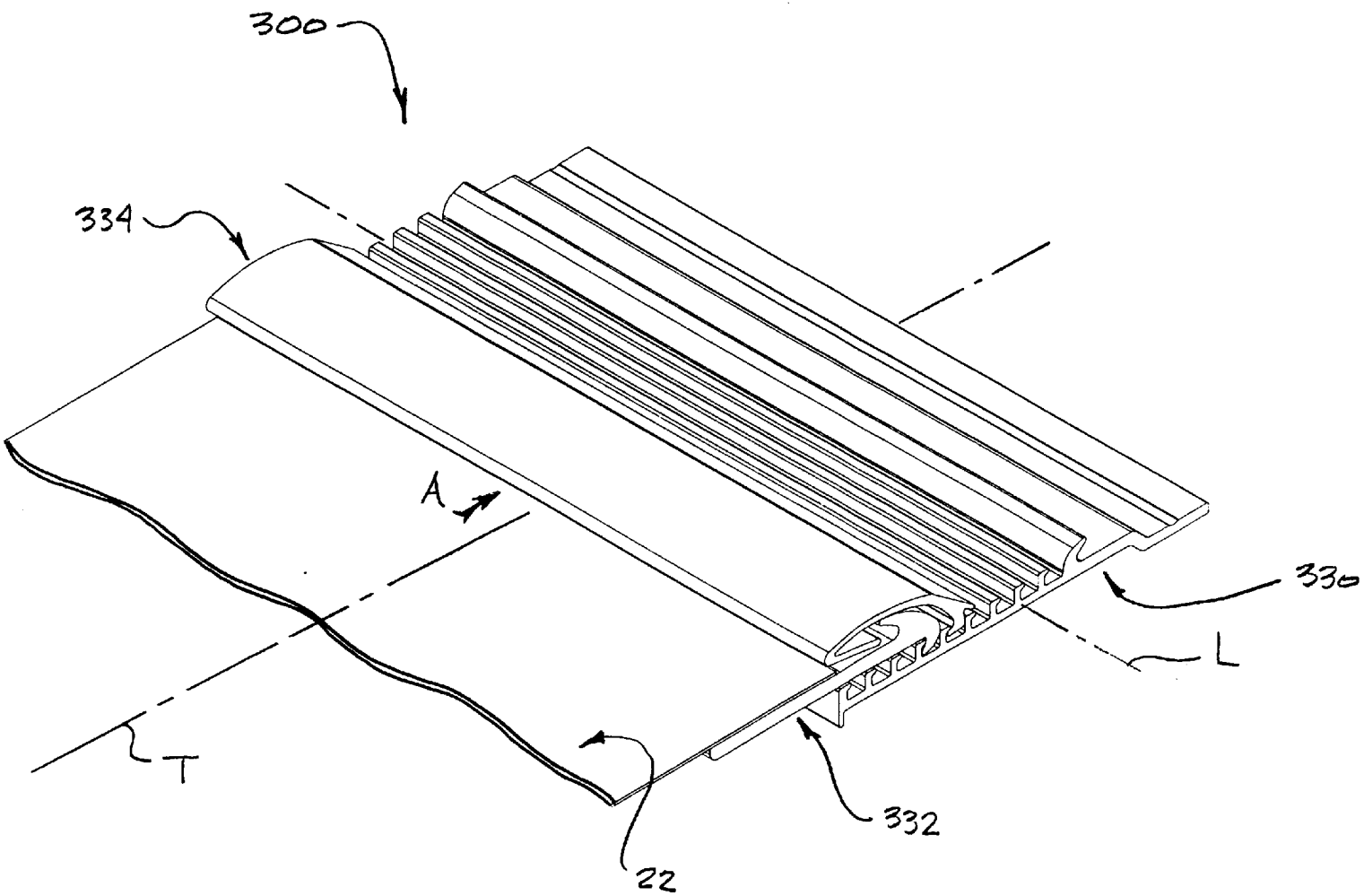
FIG. 11 is a perspective view of a frame assembly according to another form of the present invention.

Referring to FIG. 11, shown therein is a frame assembly 300 according to another form of the present invention for mounting a flexible sheeting material, such as the flexible sheeting material 22 illustrated and described above, to a substrate. The frame assembly 300 is generally comprised of an elongate support member 330, an elongate connector member 332, and an elongate cover member 334, each having a length extending along a longitudinal axis L. As will be discussed in further detail below, the support member 330 is anchored to a substrate while the connector member 332 is operatively secured to the flexible sheeting material 22 and is displaced along a transverse axis T (in the direction of arrow A) to tension the flexible sheeting material 22 to a taut state. As will also be discussed in further detail below, the support member 330 and the connector member 332 include structural features that interlock with one another to releasably interconnect the connector member 332 with the support member 330 to maintain the flexible sheeting material 22 in the taut state. The cover member 334 is releasably coupled to the support member 330 and/or the connector member 332 to conceal or shield the interconnection location between the support member 330 and the connector member 332 from the outer environment.

Figures 12, 13, 14:
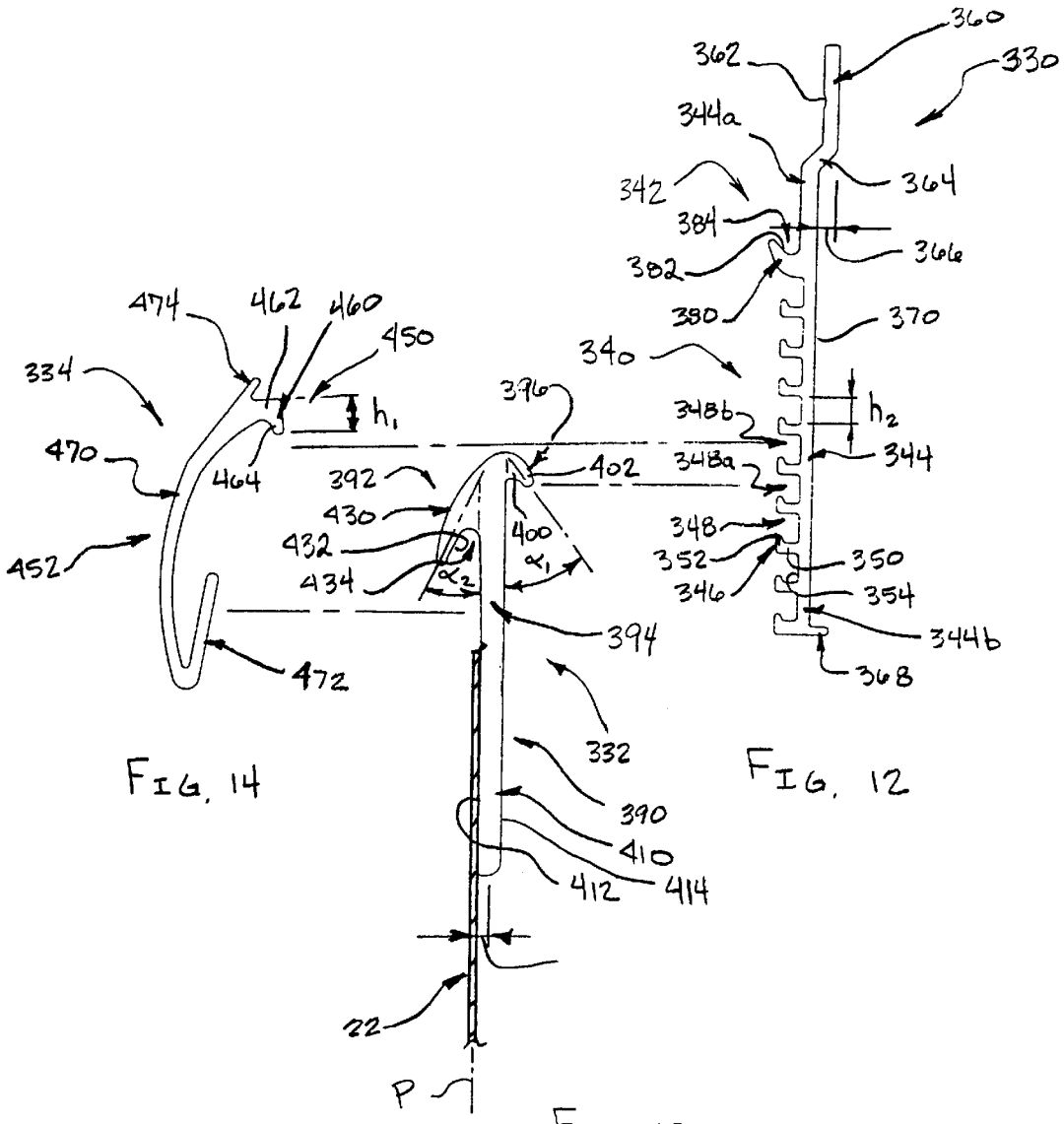
FIG. 12 is an end view of a support frame member according to one embodiment of the present invention.
FIG. 13 is an end view of a connector frame member according to one embodiment of the present invention.
FIG. 14 is an end view of a cover member according to one embodiment of the present invention.
Figure 15:
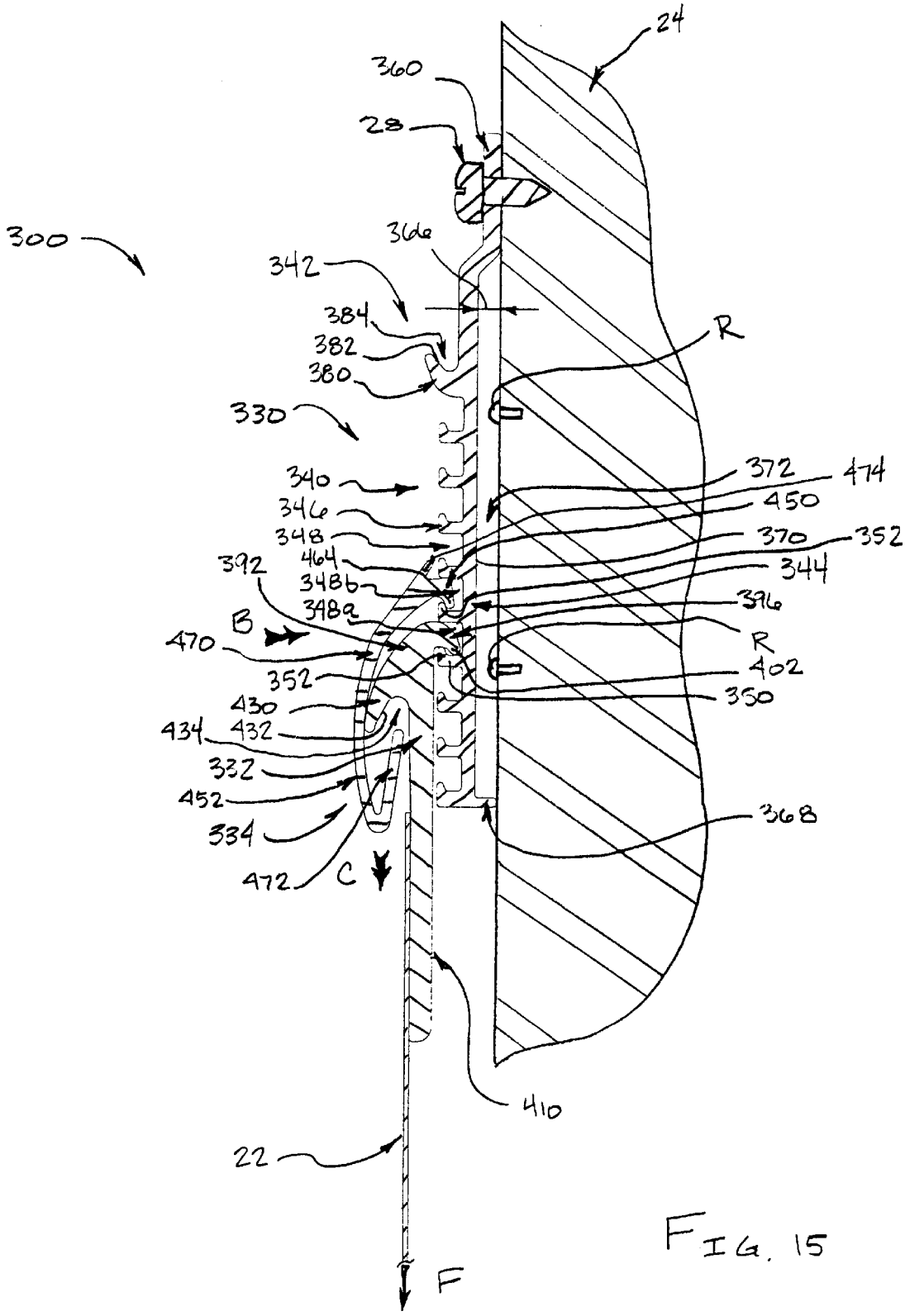
FIG. 15 is an end view of the frame assembly illustrated in FIG. 11, as anchored to a substrate.

FIGS. 12–14 illustrate additional structural details regarding the support member 330, the connector member 332, and the cover member 334, each of which will be discussed in order below. FIG. 15 illustrates an assembled view of the frame assembly 300, as attached to a substrate 24.

Referring collectively to FIGS. 12 and 15, the support member 330 generally includes an anchoring portion 340 and a tool engaging portion 342. The anchoring portion 340 is configured for attachment to the substrate 24 and also provides a means for releasably interlocking with the connector member 332 and the cover member 334. The tool engaging portion 342 is configured for engagement with an installation tool to provide a means for tensioning the flexible sheeting material 22 to a taut state, the details of which will be discussed below. The support member 330 is preferably formed of a substantially rigid material, such as, for example, aluminum. However, other materials are also contemplated, including other metallic materials such as steel, or non-metallic materials such as a plastic material or a polymeric material. Due to its relatively complex geometric configuration and substantially uniform longitudinal cross-section, the support member 330 is preferably formed as an extrusion. However, other suitable manufacturing methods are also contemplated, including casting, molding or machining.

The anchoring portion 340 of the support member 330 preferably includes an anchor plate 344 defining a number of anchor elements 346 extending substantially the entire length of the plate 344. In a preferred embodiment of the invention, the anchor plate 344 is relatively flat and the anchor elements 346 are comprised of a plurality of rows of ribs extending laterally from the plate 344. In one embodiment, the rows of anchor ribs 346 are spaced apart from one another so as to define a number of retention grooves 348 between adjacent rows of anchor ribs 346. The anchor ribs 346 are preferably oriented in a substantially parallel arrangement and are preferably uniformly offset from one another. However, it should be understood that other configurations and orientations of the anchor plate 344 and/or the anchor ribs 346 are also contemplated as falling within the scope of the present invention. It should also be understood that the support member 330 may include any number of anchor ribs 346, including a single anchor rib 346 or two or more rows of anchor ribs 346.

Each of the anchor ribs 346 preferably has a substantially uniform shape and configuration. In one embodiment of the invention, the anchor ribs 346 have an L-shaped hook configuration, including a web portion 350 extending laterally from an outwardly facing surface 354 of plate 344, and a hook portion 352 extending from the web portion 350. In a specific embodiment of the invention, the web 350 extends substantially perpendicularly from the surface 354 of plate 344, and the hook 352 extends substantially perpendicularly from the web 350. Although a specific shape and configuration of the anchor ribs 346 have been illustrated and described herein, it should be understood that other shapes and configurations of the anchor ribs 346 are also contemplated as falling within the scope of the present invention. For example, the web 350 may extend from the anchor plate 344 at an oblique angle. Similarly, the hook 352 may extend from the web 350 at an oblique angle.

The anchoring portion 340 of the support member 330 also preferably includes an attachment plate 360 extending from a first end portion 344*a* of the anchor plate 344. In one embodiment of the invention, the attachment plate 360 is relatively flat to facilitate secure engagement against a corresponding flat surface of the substrate 24. A notch 362 may be defined along the length of the attachment plate 360 through which extend a number of fasteners 28 to secure the support member 330 to the substrate 24. In a preferred embodiment of the invention, the attachment plate 360 is connected to the anchor plate 344 by an intermediate spacer portion 364 to provide an offset distance 366 therebetween, the importance of which will become apparent below. A spacer rail 368 preferably extends laterally from an inwardly facing surface 370 of a second end portion 344*b* of the anchor plate 344. The spacer rail 368 preferably extends a distance substantially equal to the distance of the offset distance 366. As shown in FIG. 15, when the support member 330 is secured to the substrate 324, an open area or recess 372 is established between the inner surface 370 of the anchor plate 344 and the substrate 24, with the attachment plate 360 and the spacer rail 368 abutting the substrate 24 to provide stabilization to the support member 330. In certain applications of the invention, the substrate 24 may include a number of rows of projections or protuberances, such as, for example, the heads of rivets R or other types of fasteners. The recessed area 372 defined between the anchor plate 344 and the substrate 24 may be positioned over such projections or protuberances to maintain secure abutment against the substrate 24 via the attachment plate 360 and the spacer rail 368.

As discussed above, the tool engaging portion 342 is configured for engagement with an installation tool to provide a means for tensioning the flexible sheeting material 22 to a taut state. The tool engaging portion 342 includes an engagement element 380 that preferably extends along substantially the entire length of the support member 330. In a preferred embodiment of the invention, the engagement element 380 is configured as a support rail extending laterally from the anchor plate 344 and oriented at an oblique angle relative to the anchor plate 344 in a direction extending away from the anchor ribs 346. The support rail 380 preferably includes a bearing surface 382 generally facing away from the anchor ribs 346 and preferably extending along substantially the entire length of support member 330. The bearing surface 382 in turn defines a groove 384. In one embodiment of the invention, the groove 384 has a circular bottom portion, and in a more specific embodiment has a hemi-cylindrical bottom portion. However, it should be understood that other shapes and configurations are also contemplated, such as, for example, other types of arcuate configurations, a polygonal configuration, or a flat configuration. It should also be understood that the inner periphery of the concave surface 382 may extend about less than 180 degrees or greater than 180 degrees. Further details regarding the function of the tool engaging portion 342 will be discussed below.

Referring collectively to FIGS. 13 and 15, the connector member 332 generally includes an anchoring portion 390 and a tool engaging portion 392. The anchoring portion 390 is configured for attachment to the flexible sheeting material 22 and also provides a means for releasably interlocking with the support member 330. The tool engaging portion 392 is configured for engagement with an installation tool to provide a means for tensioning the flexible sheeting material 22 to a taut state, the details of which will be discussed below. The connector member 332 is preferably formed of a flexibly resilient material, such as, for example, a plastic material or a polymeric material. In a specific embodiment, the connector member 332 is formed of a vinyl material, such as, for example, a polyvinyl chloride (PVC). It should be understood, however, that the connector member 332 may be formed of other types of plastic or polymeric materials, such as, for example, polyethylene, or any other suitable flexibly resilient material that would occur to one of skill in the art. In other embodiments of the invention, the connector member 332 may be formed of metallic materials, such as, for example, aluminum or steel. Due to its relatively complex geometric configuration and substantially uniform longitudinal cross-section, the connector member 332 is preferably formed as an extrusion. However, other suitable manufacturing methods are also contemplated, including casting, molding or machining.

The anchoring portion 390 of the connector member 332 preferably includes an anchor plate 394 defining at least one anchor element 396 extending substantially the entire length of the plate 394. In a preferred embodiment of the invention, the anchor plate 394 is relatively flat and the anchor element 396 is comprised of a rib extending laterally from the plate 394. In one embodiment of the invention, the anchor rib 396 is configured similar to correspond with the anchor ribs 346 associated with the support member 330. Specifically, the anchor rib 396 preferably has a hook-shaped configuration, including a web portion 400 extending laterally from the anchor plate 394, and a hook portion 402 extending from the web portion 400. In one embodiment of the invention, the web 400 extends substantially perpendicularly from the plate 394 and the hook 402 extends from the web 400 at an oblique angle $\alpha_1$. In one embodiment of the invention, the angle $\alpha_1$ falls within a range of about 30 degrees and about 60 degrees. In a specific embodiment, the angle $\alpha_1$ is about 45 degrees. It should be understood, however, that in other embodiments of the invention, the angle $\alpha_1$ may be less than 30 degrees or greater than 60 degrees. Although a specific embodiment of the anchor rib 396 has been illustrated and described herein, it should be understood that other shapes and configurations of the anchor rib 396 are also contemplated as falling within the scope of the present invention, including those alternative embodiments described above with regard to the anchor ribs 346. It should also be understood that the connector member 332 may define any number of anchor ribs 396, including two or more rows of anchor ribs 396.

The anchoring portion 390 of the connector member 332 also preferably includes an attachment plate 410 extending from the anchor plate 394. In one embodiment of the invention, the attachment plate 410 is relatively flat to facilitate secure engagement with the flexible sheeting material 22. In a preferred embodiment of the invention, the flexible sheeting material 22 is secured to a surface 412 of the attachment plate 410 by bonding, such as, for example, by radio-frequency (RF) welding or by any other bonding technique that would occur to one of skill in the art. Other methods of securing the flexible sheeting material 22 to the attachment plate 410 are also contemplated, such as, for example, by adhesion, impulse or heat sealing, fastening, sewing or any other suitable method of attachment that would occur to one of skill in the art. It is also contemplated that the attachment plate 410 could be integrally formed with the flexible sheeting material 22 to form a unitary single-piece structure. Additionally, although the sheeting material 22 is illustrated and described as being attached to the surface 412 of attachment plate 410, it should be understood that the sheeting material 22 could alternatively be attached to other portions of the plate 410, including the surface 414 opposite the surface 412.

As discussed above, the tool engaging portion 392 is configured for engagement with an installation tool to provide a means for tensioning the flexible sheeting material 22 to a taut state. The tool engaging portion 392 includes an engagement element 430 that preferably extends along substantially the entire length of the connector member 332. In a preferred embodiment of the invention, the engagement element 430 is configured as a connector rail extending laterally from the anchor plate 394 and positioned generally opposite the anchor rib 396. The connector rail 430 preferably extends from the anchor plate 394 at an oblique angle $\alpha_2$. In one embodiment of the invention, the angle $\alpha_2$ falls within a range of about 30 degrees and about 60 degrees. In a specific embodiment, the angle $\alpha_2$ is about 40 degrees. It should be understood, however, that in other embodiments of the invention, the angle $\alpha_2$ may be less than 30 degrees or greater than 60 degrees.

In a preferred embodiment of the invention, the location adjacent the intersection between the connector rail 430 and the anchor plate 394 defines a bearing surface 432 generally facing the flexible sheeting material 22. The concave bearing surface 432 in turn defines a groove 434 preferably extending along substantially the entire length of the connector member 332. In one embodiment of the invention, the groove 434 has a circular bottom portion, and in a more specific embodiment has a hemi-cylindrical bottom portion. However, it should be understood that other shapes and configurations are also contemplated, such as, for example, other types of arcuate configurations, a polygonal configuration, or a flat configuration. It should also be understood that the inner periphery of the hemi-cylindrical bottom portion of the groove 434 may extend about less than 180 degrees or greater than 180 degrees. Further details regarding the function of the tool engaging portion 392 will be discussed below.

As shown in FIG. 15, the hook-shaped anchor rib 396 of the connector member 332 is sized and shaped to be laterally received within a corresponding retention groove 348*a* in the support member 330 in the direction of arrow B. Once positioned within the retention groove 348*a*, a slight axial displacement of the connector member 332 in the direction of arrow C will cause the hook-shaped anchor rib 396 to interlock with an adjacent hook-shaped anchor rib 346 of support member 330. Notably, since the hook portions 352, 402 of the respective anchor ribs 346, 396 extend in substantially opposite directions, the hook portions 352, 402 cooperate with one another to prevent lateral disengagement of the connector member 332 from the support member 330.

As should be apparent, when a tension force F is applied to the flexible sheeting material 22, the lateral interlocking engagement between the hook portions 352, 402 will prevent the anchor rib 396 from being laterally displaced and removed from the corresponding retention groove 348 in the support member 330. However, upon removal of the tension force F from the flexible sheeting material 22, the connector member 332 may be slight displaced in a direction opposite arrow C, and the hook-shaped anchor rib 396 may be laterally displaced in a direction opposite arrow B to selectively release the connector member 332 from the support member 330. As should also be apparent, the hook-shaped anchor rib 396 may be positioned in any one of the corresponding retention grooves 348 to produce the requisite amount of tension force F within the flexible sheeting material 22. Notably, the rigid nature of the support member 330 provides adequate support to resist the axial tension force F exerted by the flexible sheeting material 22, as well as any lateral forces that might be exerted by the flexible sheeting material 22. However, the flexibly resilient nature of the connector member 332 provides a certain degree of freedom or play between the connector member 332 and the support member 330 to compensate for any misalignment therebetween and/or to aid in the insertion/removal of the anchor rib 396 into/from the corresponding retention groove 348.

Referring collectively to FIGS. 14 and 15, the cover member 334 generally includes an anchoring portion 450 and a cover portion 452. The anchoring portion 450 is configured for releasable attachment to the support member 330. The cover portion 452 is configured to extend or wrap about the tool engaging portion 392 of the connector member 332. In this manner, the cover portion 452 serves to aesthetically conceal the interconnection location between the support member 330 and the connector member 332 and to shield the interconnection location from environmental elements such as direct sunlight, thermal radiation, heat, rain, snow, ice, debris, or any other environmental element. Although the cover member 334 is illustrated and described as being releasably attached to the support member 330, it should be understood that the cover member 334 may additionally or alternatively be releasably attached to the connector member 332.

The cover member 334 is preferably formed of the same material as the support member 330, such as, for example, aluminum. However, other materials are also contemplated, including other metallic materials such as steel, or non-metallic materials such as a plastic material or a polymeric material. Due to its relatively complex geometric configuration and substantially uniform longitudinal cross-section, the cover member 334 may be formed as an extrusion. However, other suitable manufacturing methods are also contemplated, including casting, molding or machining.

The anchoring portion 450 of the cover member 334 preferably includes at least one anchor element 460 extending substantially the entire length of the cover member 334. In one embodiment of the invention, the anchor element 460 is comprised of an anchor rib configured similar to the anchor ribs 346 associated with the support member 330. The anchor rib 460 preferably has a hook-shaped configuration, including a base portion 462 and a hook portion 464. In one embodiment of the invention, the hook portion 464 extends substantially perpendicularly from the base portion 462 in a direction generally opposite the hook portions 352 of the anchor ribs 346. Although a specific embodiment of the anchor rib 460 has been illustrated and described herein, it should be understood that other shapes and configurations are also contemplated as falling within the scope of the present invention, including those alternative embodiments described above with regard to the anchor ribs 346. It should also be understood that the cover member 334 may define any number of anchor ribs 460, including two or more rows of anchor ribs 460.

The cover portion 452 includes a first portion 470 extending from the anchoring portion 450 in a first direction, and a second portion 472 extending from the first portion 470 in a generally opposite second direction so as to define a substantially U-shaped or V-shaped cover configuration. A lip or flange portion 474 is also provided which extends from the first portion 470 and beyond the base portion 462 of the anchor rib 460. Although a specific embodiment of the cover portion 452 of the cover member 334 has been illustrated and described herein, it should be understood that other shapes and configurations of the cover portion 452 are also contemplated as falling within the scope of the present invention.

Once the connector member 332 is properly secured to the support member 330, the cover member 334 may be attached to the support member 330. As illustrated in FIG. 15, the first portion 470 of the cover portion 452 extends generally along the tool engaging portion 392 of the connector member 332, with the second portion 472 wrapping about the connector rail 430 and extending inwardly toward the groove 434 formed between the connector rail 430 and the attachment plate 410. In this manner, the cover portion 452 serves to aesthetically conceal the interconnection location between the support member 330 and the connector member 332, and also provides a protective barrier to shield the interconnection location from various environmental elements. Additionally, the cover portion 452 also serves as a secondary coupling mechanism to maintain engagement between the support member 330 and the connector member 332 in the event that the anchor rib 396 should become disengaged or dislodged from the retention groove 348*a*. More specifically, if the anchor rib 396 were to somehow become disengaged from the retention groove 348*a*, the second portion 472 of the cover member 334 would slide into and be retained within the groove 434 formed along the tool engaging portion 392 of the connector member 332. As a result, the cover member 334 would temporarily serve to maintain engagement between the support member 330 and the connector member 332 until such time as the anchor rib 396 could be reinserted into the retention groove 348*a*.

As illustrated in FIG. 15, the hook-shaped anchor rib 460 of the cover member 334 is sized and shaped to be inserted within a corresponding retention groove 348*b* in the support member 330. In one embodiment of the invention, the anchor rib 460 is slidably received within the retention groove 348*b* in a direction extending along the longitudinal axis L, entering the retention groove 348*b* adjacent either end of the support member 330. Notably, since the hook portions 352, 464 of the respective anchor ribs 346, 460 extend in substantially opposite directions, the hook portions 352, 464 cooperate with one another to prevent lateral disengagement of the cover member 334 from the support member 330. In the illustrated embodiment of the invention, the anchor rib 460 is received within the retention groove 348*b* immediately adjacent the retention groove 348*a* within which the anchor rib 396 of the connector member 332 is received. However, it should be understood that the anchor rib 460 may be received within any of the retention groove 348 in the support member 330 which are not covered by the connector member 332.

In one embodiment of the invention, the hook portion 464 of the anchor rib 460 has a height $h_1$ that is substantially equal to or slightly less than a height $h_2$ of the retention grooves 348 (FIGS. 12 and 14). In this manner, the anchor rib 460 is positively retained within the retention groove 348*b* to prevent disengagement of the anchor rib 460 from the retention groove 348*b* in a lateral direction (e.g., in a direction opposite arrow B), thereby preventing inadvertent or unintentional removal of the cover member 334 from the support member 330. The lip or flange 474 extending beyond the base portion 462 of the anchor rib 460 serves to limit pivotal displacement of the cover member 334 in a direction away from the support member 330 (via abutment against the hook portion 352 of the adjacent anchor rib 346) to further prevent disengagement of the anchor rib 460 from the retention groove 348*b*.

In another embodiment of the invention, the cover member 334 may be formed of a flexibly resilient material, such as, for example, a plastic or polymeric material. In this manner, the anchor rib 460 and/or the first portion 470 of the protection portion 452 may be slightly deformed to permit lateral insertion of the hook portion 464 into the retention groove 348*b* in the direction of arrow B. As should be appreciated, upon release of the deformation force from the cover member 334, the anchor rib 460 and/or the first portion 470 of the cover portion 452 will resiliently return or snap back toward their undeformed configuration, thereby securely retaining the anchor rib 460 within the retention groove 348*b* to securely attach the cover member 334 to the support member 330.

Figure 16:
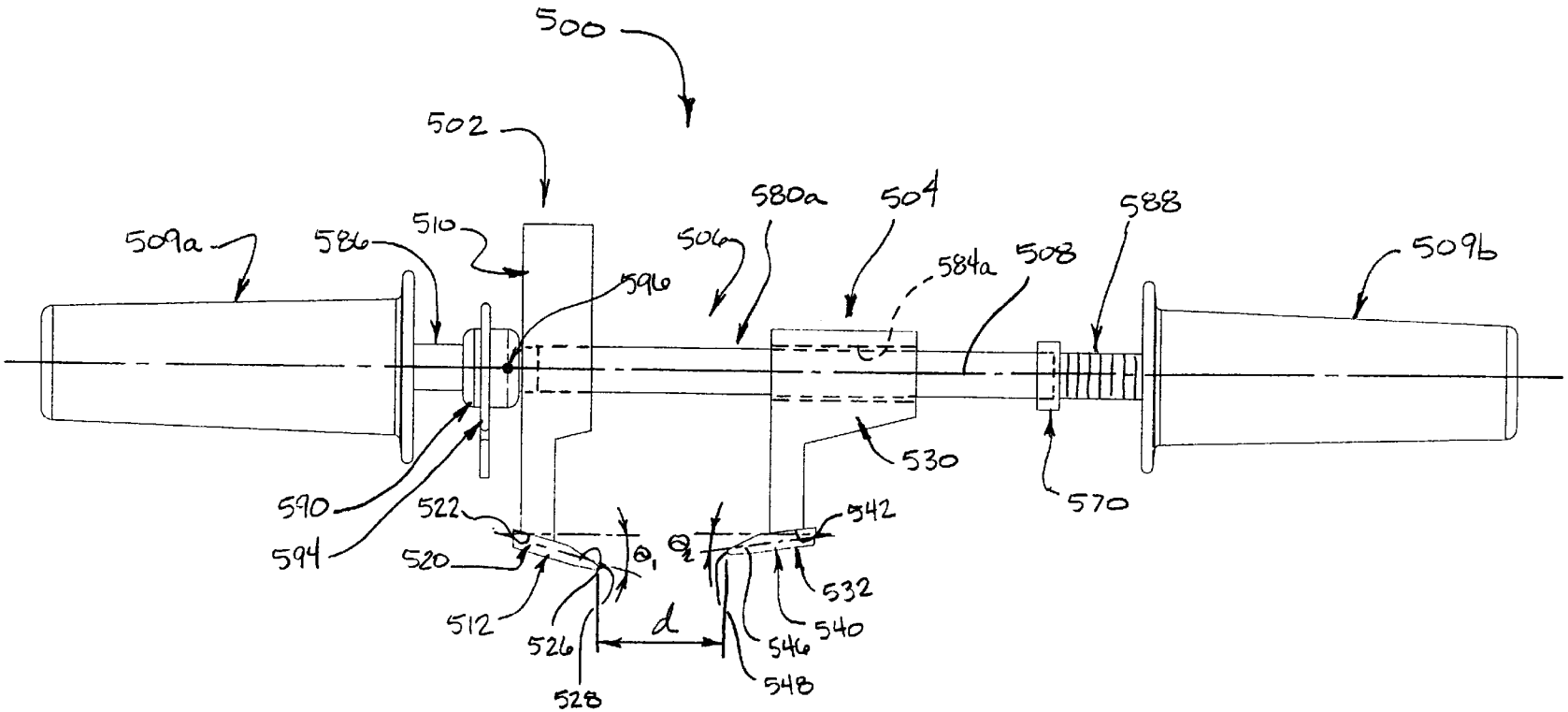
FIG. 16 is an end elevational view of an installation tool according to another form of the present invention for use in association with the frame assembly illustrated in FIG. 11.
Figure 17:
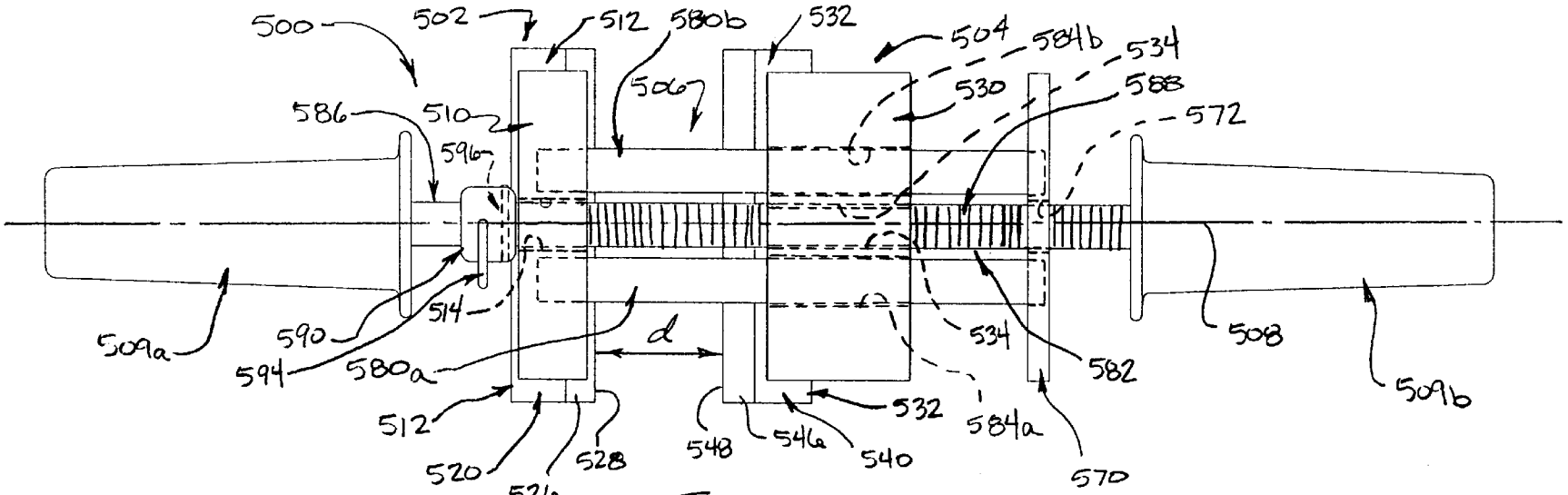
FIG. 17 is a top plan view of the installation tool illustrated in FIG. 16.
Figure 18:
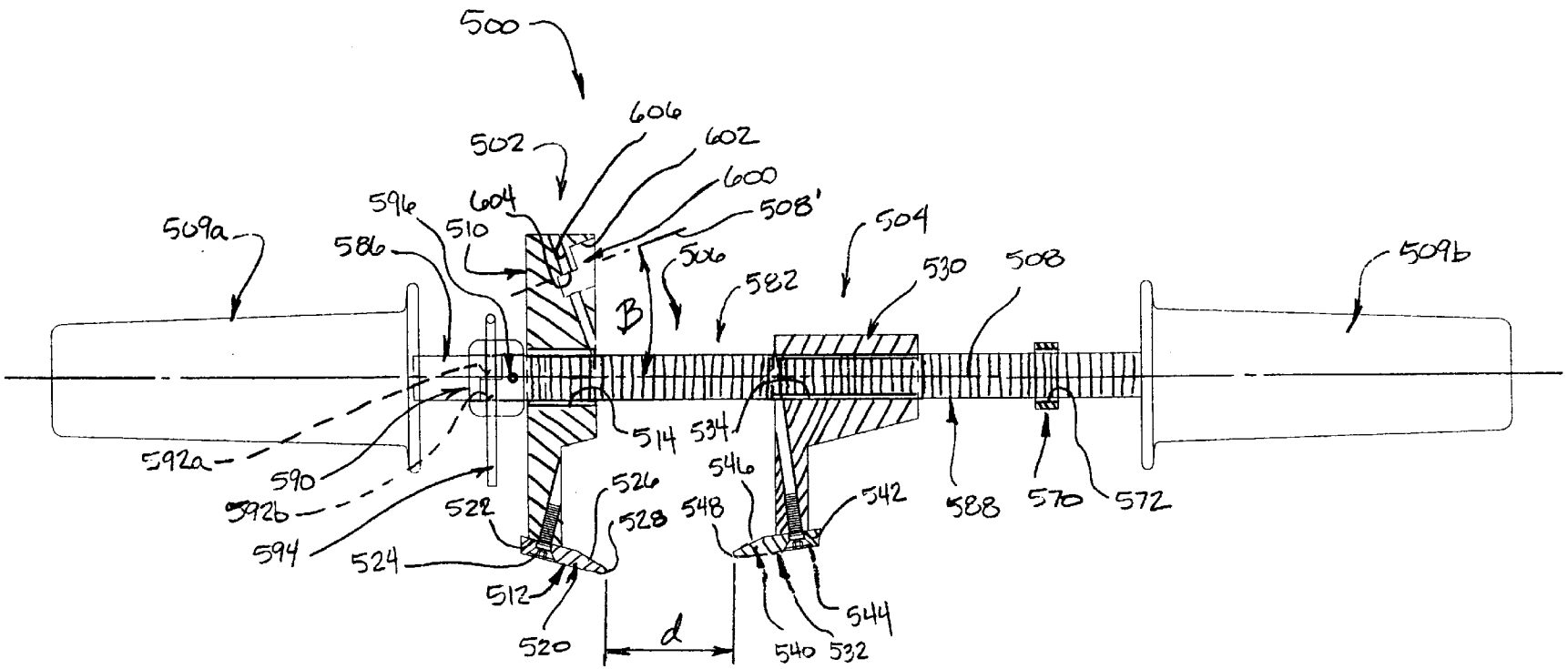
FIG. 18 is an end elevational view, partially in cross section, of the installation tool illustrated in FIG. 16.
Figure 19:
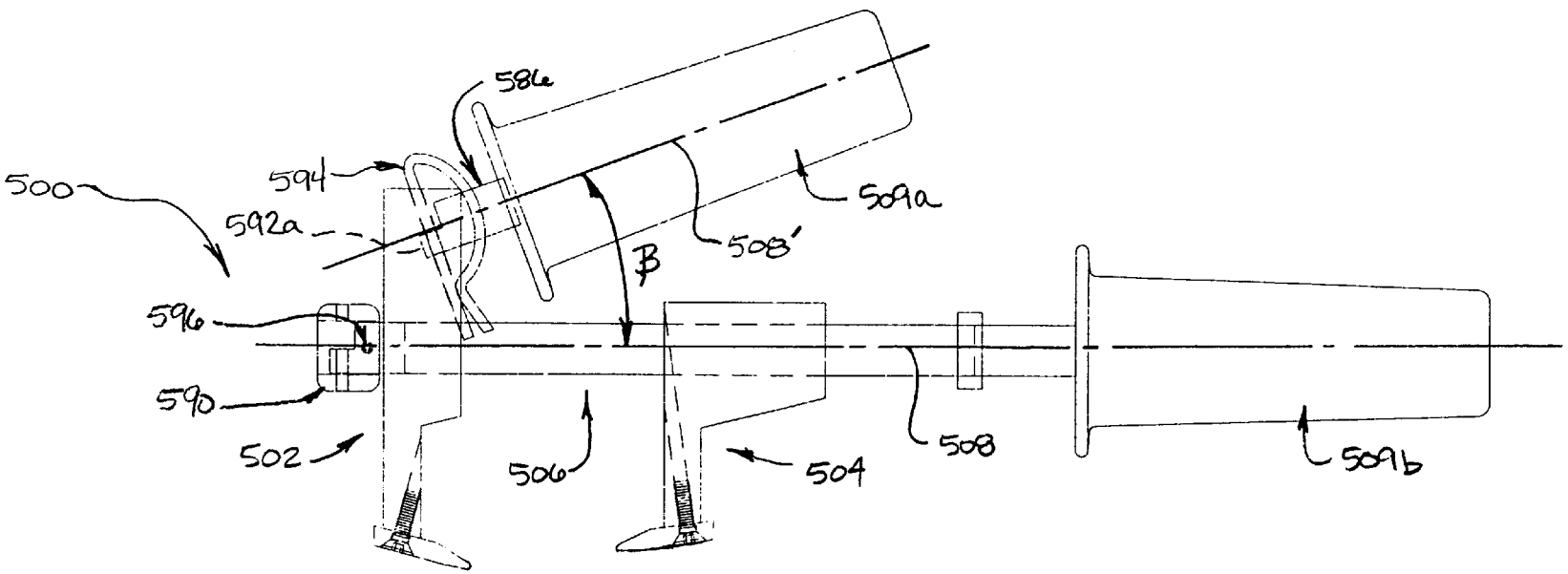
FIG. 19 is an end elevational view of the installation tool illustrated in FIG. 16, showing an alternative operational position of one of the handles.

Referring now to FIGS. 16–18, shown therein is an installation tool 500 according to one form of the present invention. As will become apparent, the installation tool 500 is configured to engage the support member 330 and the connector member 332 to produce a select amount of tension force F within the flexible sheeting material 22. The installation tool 500 is generally comprised of a stationary element 502, a movable element 504, an adjustment mechanism 506 adapted to displace the movable element 504 relative to the stationary element 502 along a displacement axis 508, and a pair of handles 509*a*, 509*b* to aid in the manipulation and handling of the installation tool 500. As will be discussed in further detail below, one of the handles 509*a* is preferably configured for positioning at either a first operational position extending generally along the displacement axis 508 (FIG. 16) or a second operation position extending generally along a second axis 508' angularly offset relative to the displacement axis 508 (FIG. 19).

In a preferred embodiment of the invention, the stationary element 502 includes a block portion 510 and an engaging portion 512 attached thereto. The block portion 510 preferably includes a non-threaded central passage 514 (FIG. 17) formed therethrough and extending generally along the displacement axis 508, the purpose of which will be discussed below. The engaging portion 512 is preferably comprised of a tool rail or plate 520 that extends along substantially the entire length of the block portion 510. The tool rail 520 is securely attached to an end surface 522 of the block portion 510 via a number of fasteners 524. However, it should be understood that the tool rail 520 may be attached to the block portion 510 via other means for attachment as would occur to one of skill in the art. It should also be understood that the tool rail 520 may be formed integral with the block portion 510 so as to define a unitary, single piece stationary element 502.

The tool rail 520 is preferably inwardly tapered at an angle $\theta_1$ relative to an axis arranged substantially parallel with the displacement axis 508. In one embodiment of the invention, the angle $\theta_1$ falls within a range of about 15 degrees and about 45 degrees. In a more specific embodiment, the angle $\theta_1$ is about 30 degrees. However, it should be understood that other angles $\theta_1$ are also contemplated, including angles less than 15 degrees or greater than 45 degrees. The tool rail 520 preferably includes a tapered distal end portion 526 defining a rounded distal engaging surface 528. In a preferred embodiment of the invention, the tapered distal end portion 526 and the distal engaging surface 528 are shaped and configured substantially complementary to that of the bearing surface 382 and the groove 384 defined by the support rail 380 of the support member 330. However, it should be understood that the tool rail 520 can take on other shapes and configurations as would occur to one of skill in the art. For example, the tool rail 520 may alternatively be configured as one or more roller devices similar to the roller devices illustrated and described above with regard to the installation tool 200.

The block portion 510 is preferably formed of a substantially rigid material, such as, for example, steel. However, other materials are also contemplated, including other metallic materials such as aluminum, or non-metallic materials such as a plastic or polymeric material. In a preferred embodiment of the invention, the tool rail 520 is formed of material having a relatively low coefficient of friction to facilitate sliding engagement between the distal engaging surface 528 and the bearing surface 382 of the support rail 380. In one embodiment, the tool rail 520 is formed of an ultra high molecular weight (UHMW) plastic material, such as, for example, a UHMW polyester material. However, other materials are also contemplated, including other plastic or polymeric materials, such as, for example, Nylon, Teflon, or a polyethylene material. It should also be understood that the tool rail 520 may be formed of a metallic material, such as, for example, steel or aluminum.

In a preferred embodiment of the invention, the movable element 504 includes a block portion 530 and an engaging portion 532 attached thereto. The block portion 530 preferably includes a threaded central passage 534 (FIG. 17) formed therethrough and extending generally along the displacement axis 508, the purpose of which will be discussed below. The engaging portion 532 is preferably comprised of a tool rail or plate 540 that extends along substantially the entire length of the block portion 530. The tool rail 540 is securely attached to an end surface 542 of the block portion 530 via a number of fasteners 544. However, it should be understood that the tool rail 540 may be attached to the block portion 530 via other means for attachment as would occur to one of skill in the art. It should also be understood that the tool rail 540 may be formed integral with the block portion 530 so as to define a unitary, single piece movable element 504.

The tool rail 540 is preferably inwardly tapered at an angle $\theta_2$ relative to an axis arranged substantially parallel with the displacement axis 508. In one embodiment of the invention, the angle $\theta_2$ falls within a range of about 5 degrees and about 45 degrees. In a more specific embodiment, the angle $\theta_2$ is about 15 degrees. However, it should be understood that other angles $\theta_2$ are also contemplated, including angles less than 5 degrees or greater than 45 degrees. The tool rail 540 preferably includes a tapered distal end portion 546 defining a rounded distal engaging surface 548. In a preferred embodiment of the invention, the tapered distal end portion 546 and the distal engaging surface 548 are shaped and configured substantially complementary to that of the bearing surface 432 and the groove 434 defined by the connector rail 430 of the connector member 332. However, it should be understood that the tool rail 540 can take on other shapes and configurations as would occur to one of skill in the art. For example, the tool rail 540 may alternatively be configured as one or more roller devices similar to the roller devices illustrated and described above with regard to the installation tool 200.

The block portion 530 is preferably formed of a substantially rigid material, such as, for example, steel. However, other materials are also contemplated, including other metallic materials such as aluminum, or non-metallic materials such as a plastic or polymeric material. In a preferred embodiment of the invention, the tool rail 540 is formed of material having a relatively low coefficient of friction to facilitate sliding engagement between the distal engaging surface 548 and the bearing surface 432 of the connector rail 430. In one embodiment, the tool rail 540 is formed of an ultra high molecular weight (UHMW) plastic material, such as, for example, a UHMW polyester material. However, other materials are also contemplated, including other plastic or polymeric materials, such as, for example, Nylon, Teflon, or a polyethylene material. It should also be understood that the tool rail 540 may be formed of a metallic material, such as, for example, steel or aluminum.

The distal engaging surface 528 of the tool rail 520 is arranged generally opposite and slightly offset from the distal engaging surface 548 of the tool rail 540, with the engaging surfaces 528, 548 being separated by a distance d. In a preferred embodiment of the invention, the distance d separating the engaging surfaces 528, 548 is adjustable by way of the adjusting mechanism 506. As illustrated most clearly in FIG. 17, the adjustment mechanism 506 is generally comprised of a pair of guide rods 580*a*, 580*b* and an adjustment screw or drive shaft 582.

The guide rods 580*a*, 580*b* extend from the stationary block 510 and are preferably arranged substantially parallel to one another and with the displacement axis 508. The guide rods 580*a*, 580*b* may be secured to the stationary block 510 by any means of attachment known to those of skill in the art, such as, for example, by a number of fasteners extending axially through the stationary block 510 and into the end portions of the guide rods 580*a*, 580*b*. The guide rods 580*a*, 580*b* are sized and shaped be slidably received within apertures 584*a*, 584*b* formed through the movable block 530. As a result, the guide rods 580*a*, 580*b* serve to guide the movable block 530 relative to the stationary block 510 generally along the displacement axis 508 as the guide rods 580*a*, 580*b* are slidably displaced through the apertures 584*a*, 584*b*.

The ends of the guide rods 580*a*, 580*b* opposite the stationary block 510 may be secured to a stabilizing plate 570 by any means of attachment known to those of skill in the art, such as, for example, by a number of fasteners extending axially through the stabilizing plate 570 and into the end portions of the guide rods 580*a*, 580*b*. The stabilizing plate 570 aids in maintaining proper alignment of the guide rods 580*a*, 580*b* in a substantially parallel orientation relative to the displacement axis 508 to facilitate uninhibited sliding displacement of the movable block 530 along the guide rods 580*a*, 580*b*. The stabilizing plate 570 also includes a non-threaded central passage 572 formed therethrough and extending generally along the displacement axis 508, the purpose of which will be discussed below.

In one embodiment of the invention, the adjustment screw or drive shaft 582 is formed as a two-piece construct, including a non-threaded shank portion 586 and a threaded shank portion 588. However, it should be understood that in other embodiments of the invention, the adjustment screw or drive shaft 582 may be formed of three or more pieces or as a unitary, single-piece construct. The non-threaded shank portion 586 extends from and is secured to the handle 509*a*. The threaded shank portion 588 extends from and is secured to the handle 509*b*. The non-threaded shank portion 586 is removably coupled to the threaded shank portion 588 via an intermediate coupling mechanism 590. The coupling mechanism 590 functions to maintain general alignment of the shank portions 586, 588 and the handles 509*a*, 509*b* along the displacement axis 508, and also provides substantially synchronous rotation between the shank portions 586, 588.

In one embodiment of the invention, the coupling mechanism 590 is configured as a thrust bushing. However, other types and configurations of coupling mechanisms are also contemplated as would occur to one of skill in the art. As illustrated in FIG. 18, the thrust bushing 290 extends about and interconnects an overlap joint defined between the end portions of the shank portions 586, 588. More specifically, the end portion of the shank portion 586 opposite the handle 509*a* defines a semi-cylindrical end portion 592*a*. Similarly, the end portion of the shank portion 588 opposite the handle 509*b* defines a semi-cylindrical portion 592*b*. A lock pin 594 is inserted through aligned openings defined through the outer bushing 590 and the overlapping semi-cylindrical portions 592*a*, 592*b*. The lock pin 594 is preferably of a type that can be manually removed by hand, the purpose of which will be discussed below. The outer bushing 590 and the lock pin 594 cooperate to securely couple the non-threaded and threaded shank portions 586, 588 of the adjustment screw 582 together so as to maintain alignment of the shank portions 586, 588 and to provide substantially synchronous rotation therebetween. The thrust bushing 590 is also secured to the end portion of the shank portion 588 via a setscrew or pin 596 to hold the thrust bushing 590 on the shank portion 588 upon removal of the lock pin 594 (FIG. 19).

The threaded shank portion 588 of the adjustment screw 582 is threadingly engaged within the threaded passage 534 formed through the movable block 530, with the end portions of the threaded shank portion 588 extending through the non-threaded passages 514 and 572 formed through the stationary block 510 and the stabilizing plate 570, respectively. As should be appreciated, rotation of the adjustment screw 582 will correspondingly adjust the distance d between the opposing engaging surfaces 528, 548 of the tool rails 520, 540 via displacement of the movable block 530 toward and away from the stationary block 510. More specifically, when the adjustment screw 582 is rotated in a first direction, the movable block 530 is correspondingly displaced toward the stationary block 510 along the displacement axis 508 so as to decrease the distance d between the engaging surfaces 528, 548. Likewise, when the adjustment screw 582 is rotated in an opposite second direction, the movable block 530 is displaced away from the stationary block 510 along the displacement axis 508 so as to increase the distance d between the engaging surfaces 528, 548. Although the entire length of the adjustment screw 582 extending between the coupling mechanism 590 and the handle 509*b* has been illustrated and described as being threaded, it should be understood that only the portion of the adjustment screw 582 that is engagable within the threaded passage 534 of the movable block 530 need necessarily be threaded. It should also be understood that in another embodiment of the invention, the entire length of the adjustment screw 282 between the handles 509*a*, 509*b* may be threaded.

The handles 509*a*, 509*b* are secured to opposite ends of the adjustment screw 582 via any means of attachment known to those of skill in the art. As should be appreciated, the handles 509*a*, 509*b* aid in handling and manipulating the tool 500. As should also be appreciated, the handles 509*a*, 509*b* aid in rotating the adjustment screw 582 to correspondingly displace the movable block 530 toward and away from the stationary block 510. In one embodiment of the invention, each of the handles 509*a*, 509*b* includes a gripping portion having a substantially cylindrical configuration sized and shaped to be easily and comfortably grasped by the operator of the tool 500. Although a specific configuration of the handles 509*a*, 509*b* has been illustrated and described herein, it should be understood that other types and configurations of handles are also contemplated as would occur to one of skill in the art.

Referring to FIG. 19, shown therein is an alternative configuration of the installation tool 500, illustrating one of the handles 509*a* in an alternative operational position. As discussed above, the non-threaded shank portion 586 of the adjustment screw 582 is removable coupled to the threaded portion 588 of the adjustment screw via the thrust bushing 590. As a result, the handle 509*a* may be selectively detached from the tool 500 and reattached to the tool 500 at an alternative position and/or orientation. To remove the handle 509*a* from the tool 500, the lock pin 594 is pulled from the thrust bushing 590 to allow the shank portion 586 of the adjustment screw 582 to be removed from the bushing 590. Notably, the bushing 590 remains in secure engagement with the shank portion 588 of the adjustment screw 582 via the setscrew 596.

As shown in FIG. 18, the stationary block 510 defines a passage 600 extending generally along an axis 508' that is oriented at an angle β relative to the displacement axis 508. The passage 600 includes a generally cylindrical portion 602 sized to receive the cylindrical shaft portion 586 therein. The passage 600 also includes a hemi-cylindrical portion 604 sized to receive the hemi-cylindrical end portion 592*a* of the shaft portion 586 therein. An aperture 606 extends through the stationary block 510 and intersects the hemi-cylindrical portion 604 of the passage 600. The aperture 606 is aligned with the aperture (not shown) extending through the hemi-cylindrical end portion 592*a* to receive the lock pin 594 therethrough to securely attach the handle 509*a* to the stationary block 510 at the orientation angle β. In one embodiment of the invention, the orientation angle β is approximately 30 degrees to 45 degrees. However, it should be understood that the orientation angle β may range anywhere from 0 degrees to 180 degrees.

The position and orientation of the handle 509*a* illustrated in FIG. 19 is particularly advantageous when the frame assembly 300 is mounted in such a manner as to provide limited clearance between the stationary block 510 and an immovable structure, such as, for example, a ceiling or wall. Repositioning of the handle 509*a* from the first operational position illustrated in FIG. 18 to the second operational position illustrated in FIG. 19 avoids interference with adjacent structures while still providing the operator with sufficient leverage to handle and manipulate the installation tool 500.

As should be appreciated, repositioning and/or reorienting the handles 509*a* to different positions and/or at different orientations provides the installation tool 500 with increased flexibility and ease of use by providing a means for exerting forces onto the installation tool 500 in more than one plane and/or in more than one direction. Although the handle 509*a* has been illustrated and described as being attached to the stationary block 510 to define an alternative handle position, it should be understood that the handle 509*a* may be attached to other portions of the tool 500, such as, for example, the movable block 530. Moreover, in should also be understood that the handle 509*b* may be configured to be selectively removed from the tool 500 and reattached to the movable block 530 or other portions of the tool 500 to define an alternative handle position and orientation. Additionally, although the installation tool 500 has been illustrated and described as including a pair of handles 509*a*, 509*b*, it should be understood that any number of handles may be used to aid in the manipulation and handling of the installation tool 500, including a single handle, or three or more handles.

Figure 20:
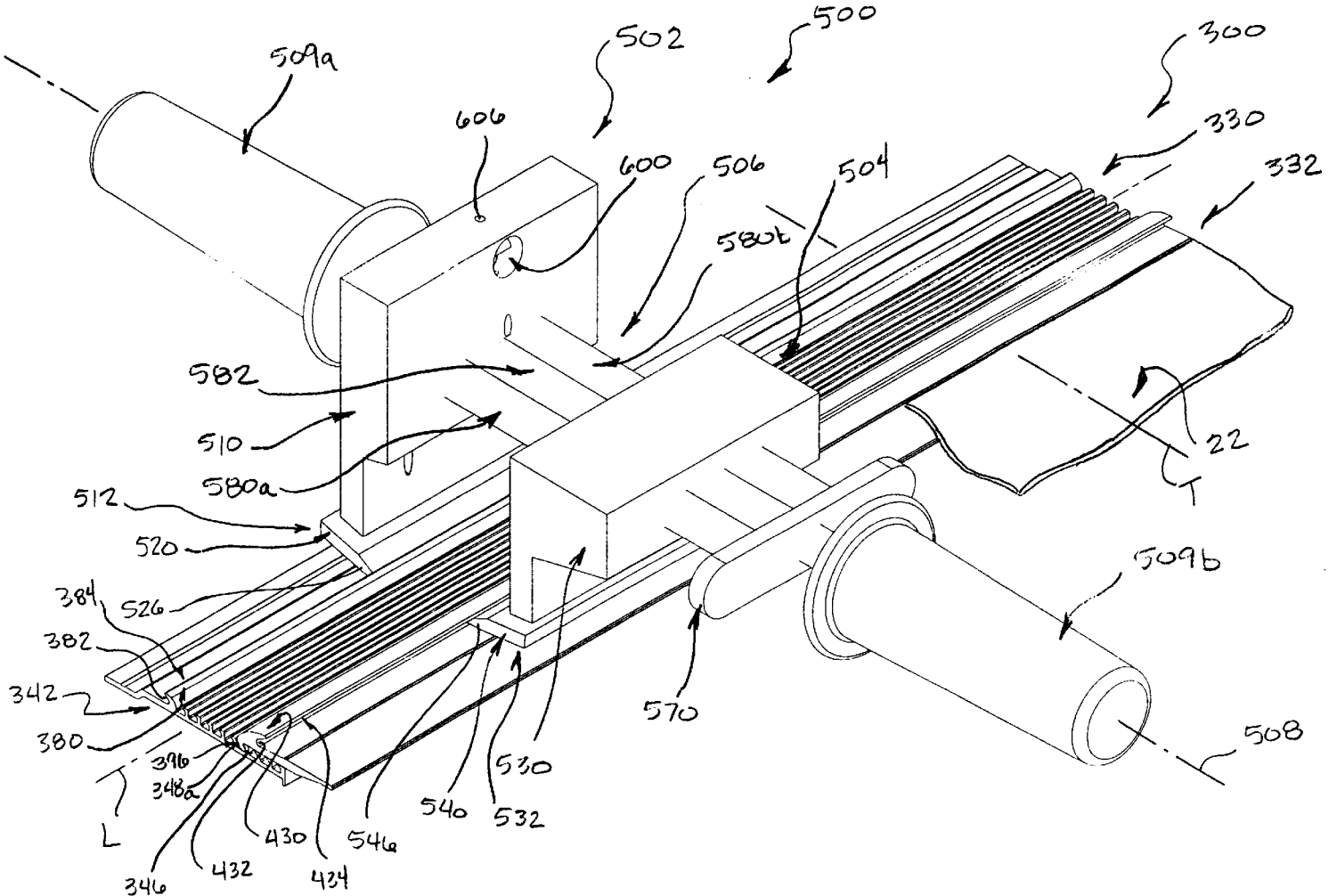
FIG. 20 is a perspective view of the installation tool illustrated in FIG. 16, as engaged with the frame assembly illustrated in FIG. 11.
Figure 21:
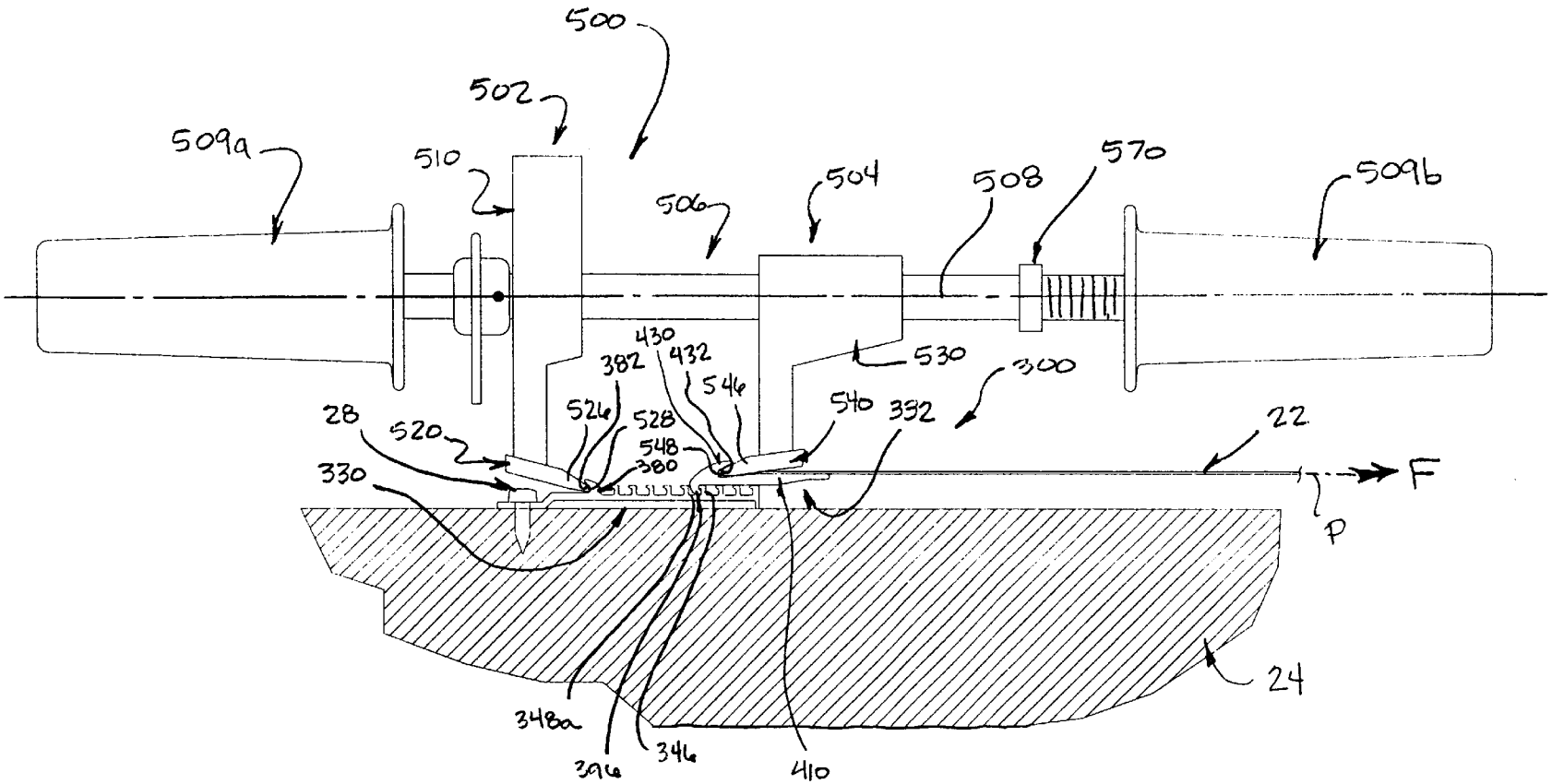
FIG. 21 is an end view of the installation tool illustrated in FIG. 16, as engaged with the frame assembly illustrated in FIG. 11 which is in turn anchored to a substrate.

Having described various structural and functional features of the frame assembly. 300 and the installation tool 500, reference will now be made to a method of mounting and tensioning the flexible sheeting material 22 according to one form of the present invention. Referring to FIGS. 20 and 21, shown therein is the installation tool 500 engaged with one of the frame sections of the frame assembly 300. As discussed above with regard to FIG. 1, the upper and lower frame sections 20*a*, 20*b* are preferably arranged in a substantially parallel and symmetrical relationship relative to one another. Similarly, the right and left frame sections 20*c*, 20*d* are preferably arranged in a substantially parallel and symmetrical relationship relative to one another. The upper portion 22*a* of the flexible sheeting material 22 is initially secured to the upper frame section 20*a* by manually positioning the anchor rib 396 of the connector member 332 within one of the retention grooves 348 in the support member 330, with the anchor rib 396 interlocking with an adjacent anchor rib 346. Similarly, one of the side portions 22*c*, 22*d* of the flexible sheeting material 22 is initially secured to a corresponding left/right frame section 20*c*, 22*d*. The installation tool 500 may then be used to tension the flexible sheeting material 22 in both the vertical direction and the horizontal direction, and to secure the unanchored end portions of the flexible sheeting material 22 to the appropriate frame section 20*a–d*.

Preferably, the installation tool 500 is initially engaged with an end portion of the selected frame section 20*a–d*. As will become apparent, displacement of the installation tool 500 along the length of the selected frame section toward the opposite end portion will correspondingly tension the flexible sheeting material 22 to a taut state. The connector member 332 may then be anchored to the corresponding support member 330 to maintain the flexible sheeting material 22 in the taut state.

The tool rail 520 mounted to the stationary block 510 is initially engaged with the support rail 380 of the support member 330. Specifically, the engaging surface 528 defined by the distal end portion 526 of the rail 520 is positioned in abutment against the bearing surface 382 of the support rail 380. As discussed above, the tool rail 520 preferably extends substantially the entire length of the stationary block 510, thereby tending to stabilize engagement between the tool rail 520 and the support rail 380 to correspondingly reduce the likelihood of disengagement of the tool 500 from the support member 330. However, the shape and configuration of the abutting bearing/engaging surfaces 382, 528 preferably allows for substantially uninhibited axial displacement of the tool rail 520 along the support rail 380. Moreover, the shape and configuration of the abutting bearing/engaging surfaces 382, 528 also preferably allows for substantially uninhibited pivotal movement of the tool rail 520 relative to the support rail 180. As discussed above, the distal end portion 526 of the tool rail 520 is preferably formed of a material having a relatively low coefficient of friction, thereby tending to facilitate sliding engagement between the abutting bearing/engaging surfaces 382, 528, particularly during axial displacement of the tool rail 520 along the support rail 380.

The tool rail 540 mounted to the movable block 530 is initially engaged with the connector rail 430 of the connector member 332. Specifically, the engaging surface 548 defined by the distal end portion 546 of the rail 540 is positioned in abutment against the bearing surface 432 of the connector rail 430. As discussed above, the tool rail 540 preferably extends substantially the entire length of the movable block 530, thereby tending to stabilize engagement between the tool rail 540 and the connector rail 430 to correspondingly reduce the likelihood of disengagement of the tool 500 from the connector member 332. However, the shape and configuration of the abutting bearing/engaging surfaces 432, 548 preferably allows for substantially uninhibited axial displacement of the tool rail 540 along the connector rail 430. As discussed above, the distal end portion 546 of the tool rail 540 is preferably formed of a material having a relatively low coefficient of friction, thereby tending to facilitate sliding engagement between the abutting bearing/engaging surfaces 432, 548, particularly during axial displacement of the tool rail 540 along the connector rail 430.

As shown in FIG. 21, when the installation tool 500 is properly engaged with the frame assembly 300, the force plane P defined by the flexible sheeting material 22 is substantially aligned with the area of abutment between the engaging surface 548 defined by the tool rail 540 and the bearing surface 432 defined by the connector rail 430. In this manner, the compression force exerted by the tool rail 540 onto the connector rail 430 will be substantially aligned with and will directly oppose the tension force F exerted by the flexible sheeting material 22 along the force plane P. As a result, engagement of the installation tool 500 with the connector member 332 will not exert an appreciable torsional or rotational loading onto the connector member 332 during tensioning of the flexible sheeting material 22. The tendency for the connector member 332 to rotate during tensioning of the flexible sheeting material 22 will therefore be substantially reduced if not eliminated entirely, thereby reducing the likelihood of the connector member 332 from becoming misaligned and/or misoriented relative to the support member 330 during tensioning of the sheeting material 22.

Once the installation tool 500 is properly engaged with the support member 330 and the connector member 332, the adjustment screw 582 is rotated in a direction which correspondingly results in threading displacement of the movable block 530 toward the stationary block 510, with the guide rods 580*a*, 580*b* directing the movable block 530 generally along the displacement axis 508. As should be apparent, displacement of the movable block 530 toward the stationary block 510 will correspondingly reduce the distance d between the engaging surface 528 of the tool rail 520 and the engaging surface 548 of the tool rail 540, which will in turn correspondingly increase the tension force F within the flexible sheeting material 22.

When the flexible sheeting material 22 is tensioned to the appropriate level of tautness, the anchor rib 396 of the connector member 332 is correspondingly positioned adjacent the lateral opening of the retention groove 348*a* defined along the support member 330. The tool 500 may then displaced along the length of the frame assembly 300, with the engaging surface 528 of the tool rail 520 being slidably displaced along the bearing surface 382 of the support rail 380, and with the engaging surface 548 of the tool rail 540 being slidably displaced along the bearing surface 432 of the connector rail 430. Axial displacement of the tool 500 along the length of the frame assembly 300 will correspondingly position the anchor rib 396 adjacent the lateral opening of the corresponding retention groove 348*a*. The simultaneous application of a slight inward force onto the movable block 530 (toward the substrate 24) will cause the tool 500 to pivot about the abutting surfaces 382, 528 of the support rail 380 and the tool rail 520. Such pivotal displacement will in turn cause the anchor rib 396 to be laterally displaced and correspondingly received within the adjacent retention groove 348*a* in the support member 330 as the installation tool 500 is progressively displaced along the length of the frame assembly 300. Once the anchor rib 396 is positioned within the appropriate retention groove 348*a*, further axial displacement of the installation tool 500 along the frame assembly 300 will result in the release of a slight amount of tension force F from the flexible sheeting material 22. As a result, the anchor rib 396 of the connector member 332 will become interlocked with the adjacent anchor rib 346 of the support member 330. Interlocking engagement between the anchor ribs 346, 396 will thereby restrict lateral displacement of the connector member 332 relative to the support member 330 to prevent disengagement therebetween so long as the flexible sheeting material 22 remains in a taut state.

As should be appreciated, the flexible sheeting material 22 is preferably slightly over-tensioned to accommodate for the slight release of tension force F necessary to cause the anchor ribs 346, 396 to interlock with one another. As discussed above, the rigid nature of the support member 330 provides the support necessary to retain the flexible sheeting material 22 in its taut state and to resist any lateral forces that might be exerted by the flexible sheeting material 22 onto the frame assembly 300. As also discussed above, the flexibly resilient nature of the connector member 332 provides a certain degree of freedom or play to compensate for any misalignment between the connector member 332 and the support member 330 during the installation procedure. The flexibly resilient nature of the connector member 332 also acts as a means for reducing the potential buildup of stress at the location of attachment between the attachment plate 410 and the sheeting material 22 which might otherwise result in detachment of the sheeting material 22 from the connector member 332.

Once the anchor rib 396 of the connector member 332 is disposed within the appropriate retention groove 348*a* in the support member 330 and interlockingly engaged with the corresponding anchor rib 346, the installation tool 500 may be removed from the frame assembly 300. Removal of the tool 500 may be accomplished by rotating the adjustment screw 582 in a direction which correspondingly results in threading displacement of the movable block 530 away the stationary block 510. As should be apparent, displacement of the movable block 530 away from the stationary block 510 will correspondingly increase the distance d between the engaging surface 528 of the tool rail 520 and the engaging surface 548 of the tool rail 540. The installation tool 500 may then be laterally removed from the frame assembly 300 and engaged with any other frame section 20*a–d* that remains in an unanchored condition until the flexible sheeting material 22 is tensioned in both the vertical and horizontal directions. As should be apparent, the flexible sheeting material 22 may be removed from the frame assembly 300 by essentially reversing the above-discussed procedure for tensioning and mounting.

As illustrated in FIG. 15, once the connector member 332 is properly engaged with the support member 330, the cover member 334 may be attached to the support member 330. In one embodiment of the invention, the hook-shaped anchor rib 460 of the cover member 334 is slidably received within the retention groove 348*b* in an axial direction (along the longitudinal axis L), entering the retention groove 348*b* adjacent either end of the support member 330. Notably, since the hook portions 352, 464 of the respective anchor ribs 346, 460 extend in substantially opposite directions, the hook portions 352, 464 cooperate with one another to prevent lateral disengagement of the cover member 334 from the support member 330. As discussed above, the cover member 334 may serve one or more functions, such as, for example, aesthetically concealing the interconnection location between the support member 330 and the connector member 332, shielding the interconnection location from various environmental elements, and/or providing a secondary coupling mechanism to maintain engagement between the support member 330 and the connector member 332 in the event that the anchor rib 396 should somehow become disengaged or dislodged from the retention groove 348*a*.

While the invention has been illustrated and described in detail in the drawings and foregoing description, the same is to be considered as illustrative and not restrictive in character, it being understood that only the preferred embodiments have been shown and described, and that all changes and modifications that come within the spirit of the invention are desired to be protected.

What is claimed is:

1. A system for mounting a flexible sheeting material to a substrate, comprising:

an elongate support member operatively secured to the substrate, said support member including an anchoring portion defining a number of first anchor elements extending along a length thereof, said support member including a tool engaging portion defining a first bearing surface extending along a length thereof;

an elongate connector member formed of a flexibly resilient material, a portion of said elongate connector member being directly attached to the flexible sheeting material, said connector member including an anchoring portion defining a number of second anchor elements extending along a length thereof, said connector member including a tool engaging portion defining a second bearing surface extending along a length thereof and facing generally opposite said first bearing surface; and a tool including a first element and a second element, said first element defining a first engaging surface positioned in abutment against said first bearing surface, said second element defining a second engaging surface positioned in abutment against said second bearing surface, said tool configured to allow relative displacement between said first and second elements to correspondingly adjust a distance between said first engaging surface and said second engaging surface; and wherein displacement of said first and second engaging surfaces along a length of said first and second bearing surfaces tensions the flexible sheeting material to a taut state, said number of first anchor elements releasably engaging said number of second anchor elements to maintain the flexible sheeting material in said taut state.

2. The system of claim 1, wherein said flexibly resilient material is a plastic material.

3. The system of claim 2, wherein said plastic material is a polyvinyl chloride.

4. The system of claim 1, wherein said end portion of the flexible sheeting material is attached to said elongate connector member by bonding.

5. The system of claim 4, wherein said end portion of the flexible sheeting material is attached to said elongate connector member by radio-frequency welding.

6. The system of claim 4, wherein each of said flexibly resilient material and the flexible sheeting material is a polyvinyl chloride.

7. The system of claim 1, wherein each of said first and second anchor elements comprises an anchor rib having a hook portion, said hook portion of said elongate connector member being interlockingly engagable with said hook portion of said elongate support member to releasably interconnect said elongate connector member and said elongate support member.

8. The system of claim 7, wherein said elongate support member defines a plurality of rows of said anchor ribs arranged in a substantially parallel relationship and spaced apart to define a retention groove between adjacent rows of said anchor ribs, said anchor rib of said elongate connector member being sized and shaped for displacement into a corresponding one of said retention grooves in a lateral direction.

9. The system of claim 8, wherein said lateral direction is substantially perpendicular to a plane defined by the flexible sheeting material.

10. The system of claim 1, wherein an area of abutment between said second engaging surface and said second bearing surface is generally aligned with a force plane defined by the flexible sheeting material.

11. The system of claim 1, wherein said first element of said tool comprises a first rail member defining said first engaging surface, said first engaging surface slidably engaged along said first bearing surface to facilitate tensioning of the flexible sheeting material to said taut state.

12. The system of claim 11, wherein said second element of said tool comprises a second rail member defining said second engaging surface, said second engaging surface slidably engaged along said second bearing surface to facilitate tensioning of the flexible sheeting material to said taut state.

13. The system of claim 11, wherein at least a portion of said first rail defining said first engaging surface is formed of a material having a relatively low coefficient of friction to facilitate sliding engagement between said first engaging surface and said first bearing surface.

14. The system of claim 13, wherein said material comprises an ultra high molecular weight polymeric material.

15. The system of claim 14, wherein said polymeric material comprises a polyester material.

16. The system of claim 11, wherein said first engaging surface is pivotally engaged with said first bearing surface to permit pivotal movement of said tool relative to said elongate support member.

17. The system of claim 11, wherein said first engaging surface defines a rounded configuration to facilitate sliding engagement along said first bearing surface.

18. A system for mounting a flexible sheeting material to a substrate, comprising:

an elongate support member operatively secured to the substrate, said support member including an anchoring portion defining a number of first anchor elements extending along a length thereof, said support member including a tool engaging portion defining a first bearing surface extending along a length thereof;

an elongate connector member formed of a flexibly resilient material, a portion of said elongate connector member being directly attached to the flexible sheeting material, said connector member including an anchoring portion defining a number of second anchor elements extending along a length thereof, said connector member including a tool engaging portion defining a second bearing surface extending along a length thereof and facing generally opposite said first bearing surface;

a tool including a first element and a second element, said first element defining a first engaging surface positioned in abutment against said first bearing surface, said second element defining a second engaging surface positioned in abutment against said second bearing surface, said tool including means for displacing said first element relative to said second element along an axis to correspondingly adjust a distance between said first engaging surface and said second engaging surface; and wherein displacement of said first and second engaging surfaces along a length of said first and second bearing surfaces tensions the flexible sheeting material to a taut state, said number of first anchor elements releasably engaging said number of second anchor elements to maintain the flexible sheeting material in said taut state.

19. A system for mounting a flexible sheeting material to a substrate, comprising:

an elongate support member operatively secured to the substrate, said support member including an anchoring portion defining a number of first anchor elements extending along a length thereof, said support member including a tool engaging portion defining a first bearing surface extending along a length thereof, said elongate support member including a recessed area for receiving protuberances extending from the substrate to stabilize engagement of said elongate support member relative to the substrate;

an elongate connector member formed of a flexibly resilient material, a portion of said elongate connector member being directly attached to the flexible sheeting material, said connector member including an anchoring portion defining a number of second anchor elements extending along a length thereof, said connector member including a tool engaging portion defining a second bearing surface extending along a length thereof and facing generally opposite said first bearing surface;

a tool including a first element and a second element, said first element defining a first engaging surface positioned in abutment against said first bearing surface, said second element defining a second engaging surface positioned in abutment against said second bearing surface; and wherein displacement of said first and second engaging surfaces along a length of said first and second bearing surfaces tensions the flexible sheeting material to a taut state, said number of first anchor elements releasably engaging said number of second anchor elements to maintain the flexible sheeting material in said taut state.

20. A system for mounting a flexible sheeting material to a substrate, comprising:

an elongate support member operatively secured to the substrate, said support member including an anchoring portion defining a number of first anchor elements extending along a length thereof, said support member including a tool engaging portion defining a first bearing surface extending along a length thereof;

an elongate connector member operatively secured to an end portion of the flexible sheeting material, said connector member including an anchoring portion defining a number of second anchor elements extending along a length thereof, said connector member including a tool engaging portion defining a second bearing surface extending along a length thereof and facing generally opposite said first bearing surface; and a tool including a first element and a second element, said first element comprising a first rail member defining a first engaging surface positioned in abutment against said first bearing surface, said second element defining a second engaging surface positioned in abutment against said second bearing surface, said tool configured to allow relative displacement between said first and second elements to correspondingly adjust a distance between said first engaging surface and said second engaging surface; and wherein said first engaging surface is slidably engaged along said first bearing surface and said second engaging surface is engaged along said second bearing surface to tension the flexible sheeting material to a taut state, said number of first anchor elements releasably engaging said number of second anchor elements to maintain the flexible sheeting material in said taut state.

21. The system of claim 20, wherein a portion of said first rail member defining said first engaging surface is formed of a material having a relatively low coefficient of friction to facilitate sliding engagement between said first engaging surface and said first bearing surface.

22. The system of claim 20, wherein said second element of said tool comprises a second rail member defining said second engaging surface, said second engaging surface slidably engaged along said second bearing surface to facilitate tensioning of the flexible sheeting material to said taut state.

23. The system of claim 22, wherein at least a portion of each of said first and second rail members defining said first and second engaging surfaces is formed of a material having a relatively low coefficient of friction to facilitate sliding engagement between said first and second engaging surfaces and said first and second bearing surfaces.

24. The system of claim 22, wherein each of said first and second rail members are disposed at an oblique angle relative to a plane defined by the flexible sheeting material.

25. The system of claim 20, wherein said first engaging surface is pivotally engaged with said first bearing surface to permit pivotal movement of said tool relative to said elongate support member.

26. The system of claim 20, wherein said first engaging surface defines a rounded configuration to facilitate sliding engagement along said first bearing surface.

27. The system of claim 20, wherein said first rail member is disposed at an oblique angle relative to a plane defined by the flexible sheeting material.

28. The system of claim 20, wherein an area of abutment between said second engaging surface and said second bearing surface is generally aligned with a force plane defined by the flexible sheeting material.

29. The system of claim 20, further comprising means for displacing said first element relative to said second element along an axis to correspondingly adjust a distance between said first engaging surface and said second engaging surface.

30. A system for mounting a flexible sheeting material to a substrate, comprising:

an elongate support member operatively secured to the substrate, said support member including an anchoring portion defining a number of first anchor elements extending along a length thereof, said support member including a tool engaging portion defining a first bearing surface extending along a length thereof;

an elongate connector member operatively secured to an end portion of the flexible sheeting material, said connector member including an anchoring portion defining a number of second anchor elements extending along a length thereof, said connector member including a tool engaging portion defining a second bearing surface extending along a length thereof and facing generally opposite said first bearing surface; and a tool including a first element and a second element, said first element comprising a first rail member defining a first engaging surface positioned in abutment against said first bearing surface, said second element defining a second engaging surface positioned in abutment against said second bearing surface; and wherein said first engaging surface is slidably engaged along said first bearing surface, said first engaging surface comprising a convex surface, said first bearing surface comprising a concave surface, and wherein said second engaging surface is engaged along said second bearing surface to tension the flexible sheeting material to a taut state, said number of first anchor elements releasably engaging said number of second anchor elements to maintain the flexible sheeting material in said taut state.

31. A system for mounting a flexible sheeting material to a substrate, comprising:

an elongate support member operatively secured to the substrate, said support member including an anchoring portion defining a number of first anchor elements extending along a length thereof, said support member including a tool engaging portion defining a first bearing surface extending along a length thereof;

an elongate connector member operatively secured to an end portion of the flexible sheeting material, said connector member including an anchoring portion defining a number of second anchor elements extending along a length thereof, said connector member including a tool engaging portion defining a second bearing surface extending along a length thereof and facing generally opposite said first bearing surface; and a tool including a first element and a second element, said first element comprising a first rail member defining a first engaging surface positioned in abutment against said first bearing surface, said second element defining a second engaging surface positioned in abutment against said second bearing surface; and wherein said first engaging surface is slidably engaged along said first bearing surface and said second engaging surface is engaged along said second bearing surface to tension the flexible sheeting material to a taut state, said number of first anchor elements releasably engaging said number of second anchor elements to maintain the flexible sheeting material in said taut state; and wherein said second element of said tool comprises at least one roller member defining said second engaging surface, said second engaging surface rotatably engaged along said second bearing surface to facilitate tensioning of the flexible sheeting material to said taut state.

32. A system for mounting a flexible sheeting material to a substrate, comprising:

an elongate support member operatively secured to the substrate, said support member including an anchoring portion defining a number of first anchor elements extending along a length thereof, said support member including a tool engaging portion defining a first bearing surface extending along a length thereof;

an elongate connector member operatively secured to an end portion of the flexible sheeting material, said connector member including an anchoring portion defining a number of second anchor elements extending along a length thereof, said connector member including a tool engaging portion defining a second bearing surface extending along a length thereof and facing generally opposite said first bearing surface; and a tool including a first element and a second element, said first element comprising a first rail member defining a first engaging surface positioned in abutment against said first bearing surface, said second element defining a second engaging surface positioned in abutment against said second bearing surface, said tool including an at least partially threaded shaft threadingly engaged within a corresponding threaded passage extending through a movable portion of said tool, one of said first and second rail members coupled to said movable portion of said tool whereby rotation of said shaft correspondingly displaces said first rail member relative to said second rail member; and wherein said first engaging surface is slidably engaged along said first bearing surface and said second engaging surface is engaged along said second bearing surface to tension the flexible sheeting material to a taut state, said number of first anchor elements releasably engaging said number of second anchor elements to maintain the flexible sheeting material in said taut state.

33. The system of claim 32, further comprising a pair of handles attached to opposite ends of said shaft to aid in rotating said shaft and manipulating said tool.

34. The system of claim 33, wherein at least one of said handles is removably coupled to said shaft, said at least one of said handles being configured for attachment to one of said first and second elements of said tool to define a second operational configuration of said tool.

35. A system for mounting a flexible sheeting material to a substrate, comprising:

an elongate support member operatively secured to the substrate, said support member including an anchoring portion defining a number of first anchor elements extending along a length thereof, said support member including a tool engaging portion defining a first bearing surface extending along a length thereof; and an elongate connector member operatively secured to an end portion of the flexible sheeting material, said connector member including an anchoring portion defining a number of second anchor elements extending along a length thereof, said connector member including a tool engaging portion defining a second bearing surface extending along a length thereof and facing generally opposite said first bearing surface; and a tool including a first element and a second element, said first element defining a first engaging surface positioned in abutment against said first bearing surface, said second element defining a second engaging surface positioned in abutment against said second bearing surface, an area of abutment between said second engaging surface and said second bearing surface being generally aligned with a force plane defined by the flexible sheeting material, said tool configured to allow relative displacement between said first and second elements to correspondingly adjust a distance between said first engaging surface and said second engaging surface; and wherein displacement of said first and second engaging surfaces along a length of said first and second bearing surfaces tensions the flexible sheeting material to a taut state, said number of first anchor elements releasably engaging said number of second anchor elements to maintain the flexible sheeting material in said taut state.

36. The system of claim 35, wherein said elongate connector member is formed of a flexibly resilient material.

37. The system of claim 36, wherein said elongate connector member and the flexible sheeting material are each formed of a polyvinyl chloride, said end portion of the flexible sheeting material being radio-frequency welded to said elongate connector member.

38. The system of claim 35, wherein said first element of said tool comprises a first rail member defining said first engaging surface, said second element of said tool comprising a second rail member defining said second engaging surface, said first and second engaging surfaces slidably engaged along said first and second bearing surfaces to tension the flexible sheeting material to said taut state.

39. The system of claim 38, wherein said first engaging surface is pivotally engaged with said first bearing surface to permit pivotal movement of said tool relative to said elongate support member.

40. The system of claim 38, wherein at least a portion of each of said first and second rail members defining said first and second engaging surfaces is formed of a material having a relatively low coefficient of friction to facilitate sliding engagement between said first and second engaging surfaces and said first and second bearing surfaces.

41. A system for mounting a flexible sheeting material to a substrate, comprising:

an elongate support member operatively secured to the substrate, said support member including an anchoring portion defining a number of first anchor elements extending along a length thereof, said support member including a tool engaging portion defining a first bearing surface extending along a length thereof;

an elongate connector member operatively secured to an end portion of the flexible sheeting material, said connector member including an anchoring portion defining a number of second anchor elements extending along a length thereof, said connector member including a tool engaging portion defining a second bearing surface extending along a length thereof and facing generally opposite said first bearing surface; and a tool including a first element and a second element, said first element defining a first engaging surface positioned in abutment against said first bearing surface, said second element defining a second engaging surface positioned in abutment against said second bearing surface, said tool configured to allow relative displacement between said first and second elements to correspondingly adjust a distance between said first engaging surface and said second engaging surface, said first and second engaging surfaces engaged along said first and second bearing surfaces to tension the flexible sheeting material to a taut state, said number of first anchor elements releasably engaging said number of second anchor elements along an interconnection location to maintain the flexible sheeting material in said taut state; and an elongate cover member engaged with one of said elongate support member and said elongate connector member to cover said interconnection location.

42. The system of claim 41, wherein said elongate cover member includes an anchoring portion defining a number of third anchor elements releasably engaging said number of first anchor elements defined by said elongate support member to releasably attach said elongate cover member to said elongate support member.

43. The system of claim 42, wherein said elongate cover member extends along said tool engaging portion of said elongate connector member.

44. The system of claim 43, wherein said elongate cover member includes a flange portion disposed adjacent and generally aligned with said second bearing surface.

45. The system of claim 43, wherein said first element of said tool comprises a first rail member defining said first engaging surface, said second element of said tool comprising a second rail member defining said second engaging surface, said first and second engaging surface slidably engaged along said first and second bearing surfaces to tension the flexible sheeting material to said taut state.

* * * * *